US010513811B2

(12) United States Patent
Suzuki

(10) Patent No.: US 10,513,811 B2
(45) Date of Patent: Dec. 24, 2019

(54) SEWING MACHINE

(71) Applicant: JANOME SEWING MACHINE CO., LTD., Hachioji-shi, Tokyo (JP)

(72) Inventor: Ryosuke Suzuki, Hachioji (JP)

(73) Assignee: JANOME SEWING MACHINE CO., LTD., Hachioji-shi, Tokyo (JP)

( * ) Notice: Subject to any disclaimer, the term of this patent is extended or adjusted under 35 U.S.C. 154(b) by 290 days.

(21) Appl. No.: 15/426,058

(22) Filed: Feb. 7, 2017

(65) Prior Publication Data

US 2017/0260671 A1 Sep. 14, 2017

(30) Foreign Application Priority Data

Mar. 10, 2016 (JP) ..... 2016-047568

(51) Int. Cl.
*D05C 9/06* (2006.01)
*D05C 9/18* (2006.01)

(52) U.S. Cl.
CPC ..... *D05C 9/06* (2013.01); *D05C 9/18* (2013.01)

(58) Field of Classification Search
CPC . D05C 9/06; D05C 9/18; D05B 21/00; D05B 19/16
See application file for complete search history.

(56) References Cited

U.S. PATENT DOCUMENTS 103,318 A * 5/1870 Fisher ..... D05B 39/00 112/148
461,369 A * 10/1891 Pilling ..... D05B 29/06 112/150
666,391 A * 1/1901 Oppenheim ..... D05B 85/06 112/150
876,105 A * 1/1908 Smith ..... D05B 35/08 112/134
955,619 A * 4/1910 Veatch ..... D05B 39/00 112/148
968,346 A * 8/1910 Hamlin ..... D05B 35/10 112/150
1,704,170 A * 3/1929 Carmichael ..... D05B 35/062 112/139

(Continued)

FOREIGN PATENT DOCUMENTS

CN 1396970 A 2/2003
JP 2009-219596 A 10/2009
TW 242656 B 3/1995

*Primary Examiner* — Danny Worrell
*Assistant Examiner* — Larry D Worrell, Jr.
(74) *Attorney, Agent, or Firm* — Yokoi & Co., U.S.A.; Toshiyuki Yokoi

(57) ABSTRACT

The present invention provides a sewing machine enabling to sew a high-quality pattern without using an embroidery frame. In a sewing machine 1, a pattern is sewn while a fabric 100 is fed in a sewing direction by a feed dog 2*a*. The sewing machine 1 has a fabric guide 14. The fabric guide 14 has a guide portion 16 which extends straight in a sewing direction to serve as a basis of a cloth feed in an amplitude direction of the needle. The carriage 10 makes the fabric guide 14 slide in the amplitude direction of the needle by a predetermined distance. Thus, the guide portion 16 serves as an index of the position of the fabric 100 to be located for sewing the next pattern line. Since the fabric 100 can be accurately located for sewing the next pattern line, high-quality pattern can be sewn.

6 Claims, 20 Drawing Sheets

(56) References Cited

U.S. PATENT DOCUMENTS 2,600,597 A * 6/1952 Winberg ..... D05B 29/10 112/322
2,876,721 A * 3/1959 Burke ..... D05B 35/107 112/148
3,221,685 A * 12/1965 Greenberg ..... D05B 23/005 112/138
3,889,614 A * 6/1975 Nicolay ..... D05B 35/10 112/153
3,986,647 A * 10/1976 Kendall ..... D05B 35/08 223/38
4,010,701 A * 3/1977 Helfont ..... D05B 39/00 112/148
4,258,637 A * 3/1981 Hannemann ..... D05B 35/105 112/311
4,945,843 A * 8/1990 Keller ..... D05B 39/00 112/148
5,148,760 A * 9/1992 Miyauchi ..... D05B 35/08 112/144
5,195,442 A 3/1993 Meier
5,209,171 A * 5/1993 Anderson ..... D05B 23/00 112/137
5,555,831 A 9/1996 Teeth et al.
6,123,039 A * 9/2000 Niino ..... D05B 29/08 112/235
7,080,605 B1 * 7/2006 Anderson ..... D05B 27/12 112/318
8,573,145 B2 * 11/2013 Dickerson ..... D05B 19/16 112/470.02
8,805,568 B2 * 8/2014 Maki ..... D05B 19/12 112/470.03
8,919,269 B1 * 12/2014 Chen ..... D05B 27/14 112/304
9,157,175 B2 * 10/2015 Sawada ..... D05B 35/064
2003/0136320 A1 7/2003 Hosagasi

* cited by examiner (1)
14

(2)

(3)
D2

(4)

(5)
14

(6)

(7)
D2

(8)

laterally inverted

D2

14

D2

SEWING MACHINE

CROSS-REFERENCES TO RELATED APPLICATIONS

This patent specification is based on Japanese patent application, No. 2016-047568 filed on Mar. 10, 2016 in the Japan Patent Office, the entire contents of which are incorporated by reference herein.

BACKGROUND OF THE INVENTION

1. Field of the Invention

The present invention relates to a sewing machine for sewing a pattern on fabric.

2. Description of the Related Art

By sewing a plurality of seams on the fabric, the seams can look like the pattern. In the sewing machine, an upper thread and a lower thread are intertwined by movements of a needle and a hook to form the seams. In the sewing machine, the fabric is fed by a feed dog to change the position of the needle penetrating the fabric relatively back and forth. In addition, in the sewing machine, the position of the needle penetrating the fabric is relatively changed to right and left by swinging the needle to right and left.

Further, in some types of sewing machines, an embroidery frame can be attached (as shown in Patent document 1, for example). The embroidery frame is a frame body for holding the fabric. The embroidery frame is composed of an upper frame and a lower frame. The embroidery frame holds the fabric by sandwiching the fabric between the upper frame and the lower frame. The embroidery frame is connected to a biaxial actuator. The sewing machine moves the embroidery frame to right and left based on an embroidery data. Moving direction and moving amount of the actuator are stored in the embroidery data. Accordingly, the sewing machine changes the position of the needle penetrating the fabric to back and forth and to right and left.

[Patent document 1] Japanese Unexamined Patent Application Publication No. 2009-219596

BRIEF SUMMARY OF THE INVENTION

When sewing the pattern by using the embroidery frame, the pattern can be sewn within the size of a movable range of the embroidery frame. On the other hand, when sewing the pattern by using a feed dog mechanism and an amplitude mechanism of the needle, it is recommended that a width of the pattern is equal to or less than the maximum amplitude of the needle. When the width of the pattern exceeds the maximum amplitude of the needle, the fabric should be moved by a hand of a user. Therefore, quality of the pattern depends on ability of the user. Even when sewing a large pattern by arranging a plurality of pattern lines, the fabric should be moved by the hand of the user for sewing the next pattern line. Also in this case, unless the fabric is moved accurately, the pattern lines can be separated with each other or overlapped with each other.

The present invention provides a sewing machine enabling to sew a high-quality pattern without using the embroidery frame.

Hereafter, embodiments of the present invention will be explained in detail. However, the present invention is not limited to the embodiments below.

In one embodiment of the present invention, a sewing machine is comprised of: a fabric guide having a guide portion and a holding portion, the guide portion extending in a sewing direction, the holding portion having a pressing roller which is rotated with respect to the sewing direction for pressing a fabric abutted on the guide portion; a carriage having a fixing portion which fixes the fabric guide, the carriage being slidable in an amplitude direction of a needle by a predetermined distance each; a cloth presser foot which is raised from the fabric when the carriage is slid, and a controller for sliding the carriage in the amplitude direction of the needle by the predetermined distance.

The sewing machine can sew a pattern by combining in the amplitude direction a plurality of object patterns having a width equal to or narrower than a maximum amplitude of the needle attached to the sewing machine, and the controller can make the carriage slide by a distance equal to or less than the maximum amplitude of the needle attached to the sewing machine, the distance being a positive integral multiple of the width of each of the object patterns.

The controller can have: a calculator for comparing a length of the maximum amplitude of the needle with a length of the width of each of the object patterns; and a sewing controller for making the needle saw the plurality of object patterns arranged in the amplitude direction within a range of the maximum amplitude of the needle without moving the carriage when the length of the maximum amplitude of the needle compared by the calculator is equal to or more than twice the length of the width of each of the object patterns.

The controller can have a carriage controller for making the carriage slide by the width of the plurality of the object patterns after the plurality of object patterns are sewn.

The controller can have a sewing function for inversing the object patterns neighboring in the amplitude direction of the needle with each other with respect to the amplitude direction of the needle.

The controller can have a sewing function for reversing the sewing direction of the neighboring object patterns with each other.

In the present invention, since the fabric can be moved precisely in the direction perpendicular to the moving direction of the feed dog without using the embroidery frame. Thus, high-quality pattern can be easily sewn.

BRIEF DESCRIPTION OF THE DRAWINGS

FIG. 2A shows a contracted state and FIG. 2B shows an extended state.

FIG. 3A shows a plan view and FIG. 3B shows a front view.

DETAILED DESCRIPTION OF THE INVENTION

1. First Embodiment

[1-1. Configuration]

(Entire Configuration of Sewing Machine)

Figure 1A:
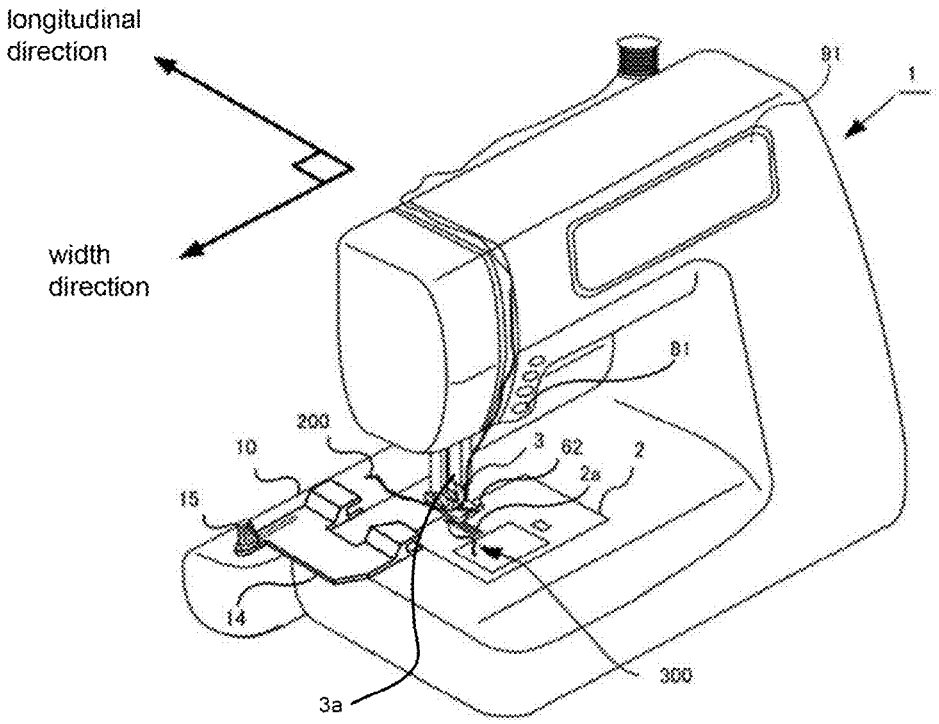
FIGS. 1A and 1B are perspective views showing an entire configuration of a sewing machine of the first embodiment.
Figure 1B:
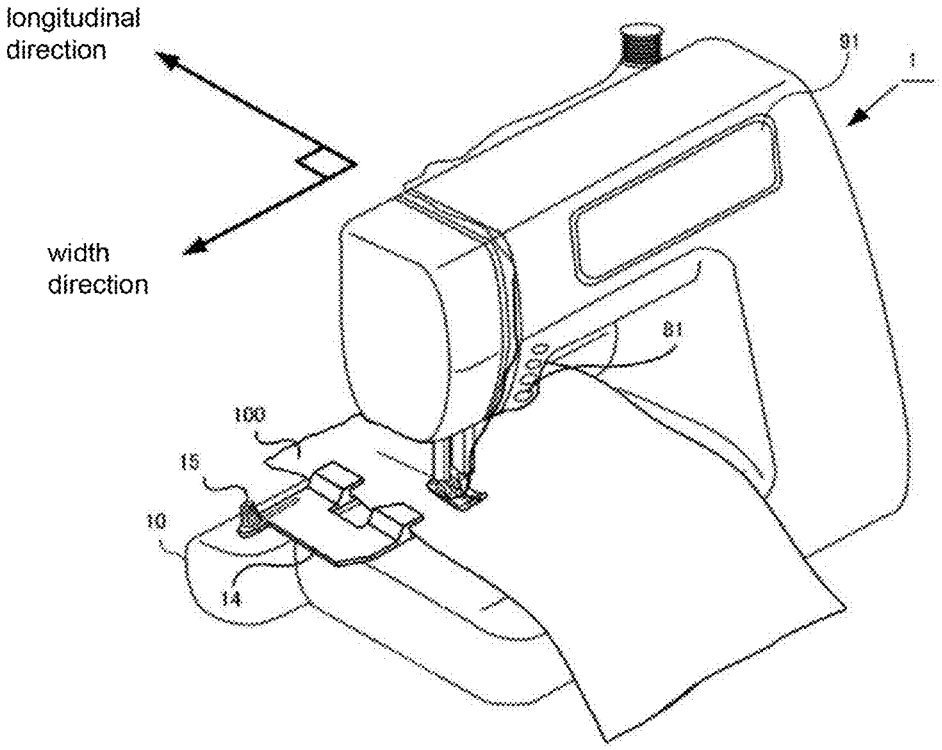

FIGS. 1A and 1B are perspective views showing a sewing machine of the present embodiment. FIG. 1A shows a state where a fabric is not placed on the sewing machine. FIG. 1B shows a state where the fabric is placed on the sewing machine. A sewing machine 1 is a domestic or industrial device for sewing a fabric 100. In the sewing machine 1, as shown in FIGS. 1A and 1B, the fabric 100 is placed on a needle plate 2. A needle hole is formed at a position where a needle 3 of the needle plate 2 is penetrating. In the sewing machine 1, the needle 3 is penetrated through the fabric 100 by lowering the needle bar. Thus, an upper thread 200 and a lower thread 300 are interlaced with each other to form seams. The upper thread 200 is wound around a thread reel and supplied to the needle 3. The lower thread 300 is wound around a bobbin.

In the sewing machine 1, the pattern is sewn by forming a plurality of seams on the fabric 100. The pattern has a certain size both in a sewing direction and in an amplitude direction of the needle. When sewing the pattern, the fabric 100 is moved in the sewing direction and the amplitude direction of the needle. The sewing machine 1 has a feed dog 2*a* to move the fabric 100 in one direction. The fabric 100 is moved together with the feed dog 2*a* to change the position of the needle 3 penetrated through the fabric 100 to back and forth. The direction of feeding the fabric fed by the feed dog 2*a* is referred to as a sewing direction or a longitudinal (length) direction of the pattern. In addition, the sewing machine 1 has a needle bar to which the needle 3 is attached. The sewing machine 1 swings the needle bar in right and left directions by a predetermined width using an amplitude motor 24 (shown in FIG. 4) as a power source. The direction of swinging the needle is perpendicular to the sewing direction. Because of this, the sewing machine 1 changes the position of the needle 3 penetrating through the fabric 100 in the right and left directions within a predetermined range. The amplitude direction of the needle swung by the amplitude motor is referred to as a width direction of the pattern.

The sewing machine 1 has a fabric guide 14 which serves as a basis when the fabric 100 is moved in the width direction. The sewing machine 1 makes the fabric guide 14 slide in the width direction. The fabric 100 is held by the fabric guide 14 and moved together with the fabric guide 14 when the fabric guide 14 is slid. Thus, the position of the needle 3 to be penetrated through the fabric 100 is changed to right and left in the width direction.

The sewing machine 1 explained above has an operation means 8 as shown in FIG. 4 to drive the sewing machine 1 according to operations of the operation means 8 operated by a user. The operation means 8 is an input interface to receive an input from the user. The user instructs to start or stop sewing, moves the fabric guide 14 and selects the pattern for sewing by operating the operation means 8. As the operation means 8 for instructing to start or stop sewing, a tact switch 81 and a foot controller are exemplified. The tact switch 81 instructs to start or stop sewing. The foot controller starts sewing by stepping on the foot controller by a foot placed on the foot controller, and stops sewing by releasing the foot from the foot controller. As the operation means 8 for moving the fabric guide 14, fabric guide moving keys 40 (shown in FIG. 10) are exemplified. The fabric guide moving keys 40 is displayed on a touch panel 91, which serves both as the operation means 8 and a display means 9. In addition, candidates of the pattern to be sewn are displayed on the touch panel 91 to allow the user to select the pattern to be sewn from the candidates.

(Configuration of Carriage)

Then, the explanation will be made in more detail about the fabric guide 14. As shown in FIGS. 1A and 1B, the fabric guide 14 is slid in the width direction of the pattern by a carriage 10 provided on the sewing machine 1. The carriage 10 is formed in a box shape having an approximately rectangular shape so that the width length is longer than the depth and the height. The carriage 10 is detachably fixed to the back surface of the sewing machine 1 so that the width direction of the carriage 10 is laid along the sewing machine 1.

Figure 2A:
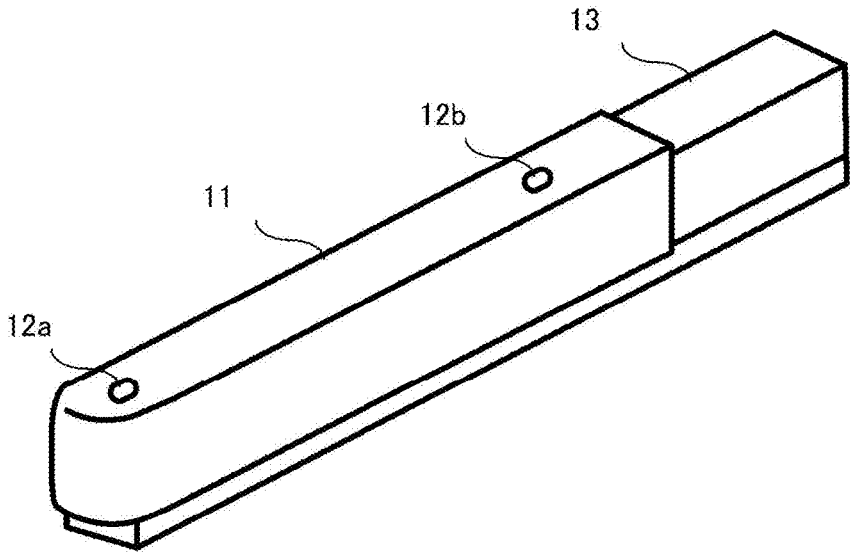
FIGS. 2A and 2B are perspective views showing a configuration of a carriage of the first embodiment.
Figure 2B:
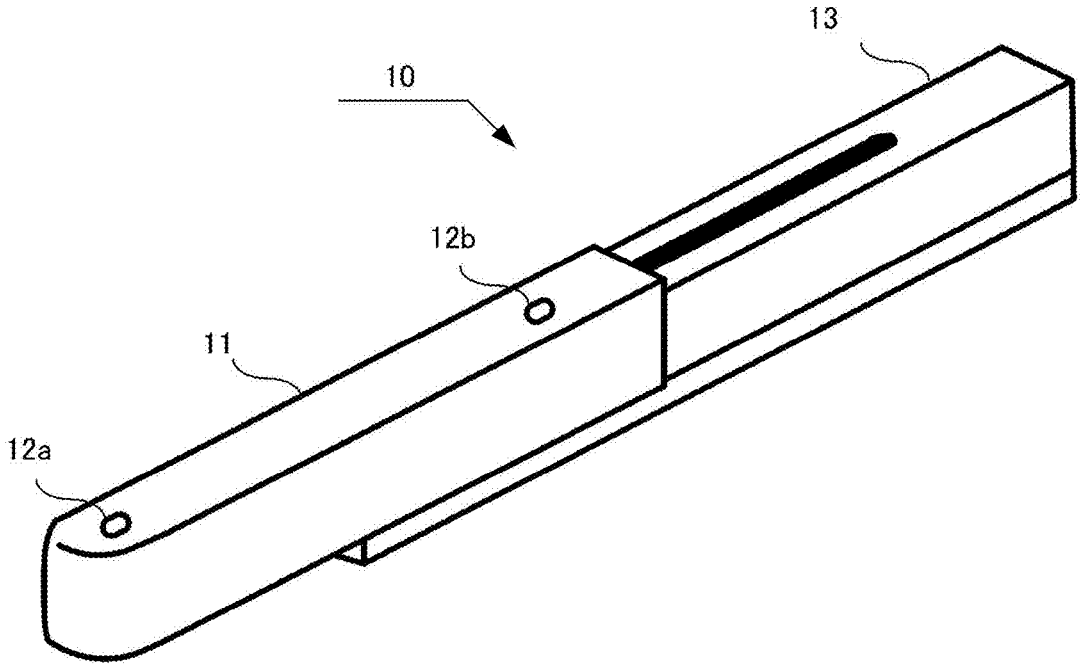

The carriage 10 is extendable/contractable in the width direction. The fabric guide 14 is moved in the width direction of the pattern by a predetermined distance in accordance with the extension and contraction of the carriage 10. The moving distance of the carriage 10 is arbitrarily changed depending on the later described arrangement width of the pattern lines which form the entire pattern. The predetermined distance can be changed depending on the kind of the pattern to be sewn. The predetermined distance can be changed according to the sewing data used when sewing the pattern. Alternatively, after one of the pattern lines is sewn, the user can input the arrangement width between the previously sewn pattern line to the next pattern line. Because of this, the fabric guide 14 is moved by the predetermined distance after one of the pattern lines is sewn. Thus, the fabric can be precisely moved. By repeating the sewing of the pattern line and the movement of the fabric guide 14 by the predetermined distance, a plurality of pattern lines is arranged and a large pattern is sewn. FIGS. 2A and 2B are perspective views showing an entire carriage 10. FIG. 2A shows a contracted state and FIG. 2B shows an extended state. The carriage 10 is comprised of a base portion 13 and a movable portion 11. The movable portion 11 is covered on the base portion 13 from above. Thus, the carriage 10 has a double cylinder structure formed by the base portion 13 and the movable portion 11. The base portion 13 is fixed to the back surface of the sewing machine 1. A carriage motor 23 is built in the base portion 13. The movable portion 11 is slid with respect to the base portion 13 by the driving force of the carriage motor 23. Thus, the entire carriage 10 is extended or contracted.

A rail is extended inside the base portion 13. A connection portion to be connected with the movable portion 11 is slidably attached to the rail. The connection portion is fixed to one point of an endless belt extended in the width direction in the base portion 13. The endless belt is driven by the carriage motor 23. When the endless belt is driven by the carriage motor 23 and the connection portion is moved on the rail, the movable portion 11 attached to the connection portion is slid in the width direction of the pattern (width direction of the carriage 10) with respect to the base portion 13.

Fixing portions 12*a*, 12*b* are provided on the movable portion 11 to fix the fabric guide 14. The position of the fixing portion 12*a* is specified so that the fabric guide 14 fixed to the fixing portion 12*a* is located on the left side of a needle bar 3*a*. When the carriage 10 is fixed to the sewing machine 1, the movable portion 11 changes a relative position with respect to the sewing machine 1. The position of the fixing portion 12*a* is specified so that the fabric guide 14 is always located on the left side of the needle bar 3*a* in a state that the carriage 10 is extended or contracted. On the other hand, the position of the fixing portion 12*b* is specified so that the fabric guide 14 fixed to the fixing portion 12*b* is located on the right side of the needle bar 3*a*. Similar to the fixing portion 12*a*, the position of the fixing portion 12*b* is specified so that the fabric guide 14 is always located on the right side of the needle bar 3*a* in a state that the carriage 10 is extended or contracted. The fixing portions 12*a*, 12*b* are screw holes, for example. When the fixing portions 12*a*, 12*b* are the screw holes, the fabric guide 14 are fixed by using screws 15. Because of this, the fabric guide 14 is moved in parallel with the width direction of the pattern in accordance with the extension and contraction of the carriage 10.

Figure 3A:
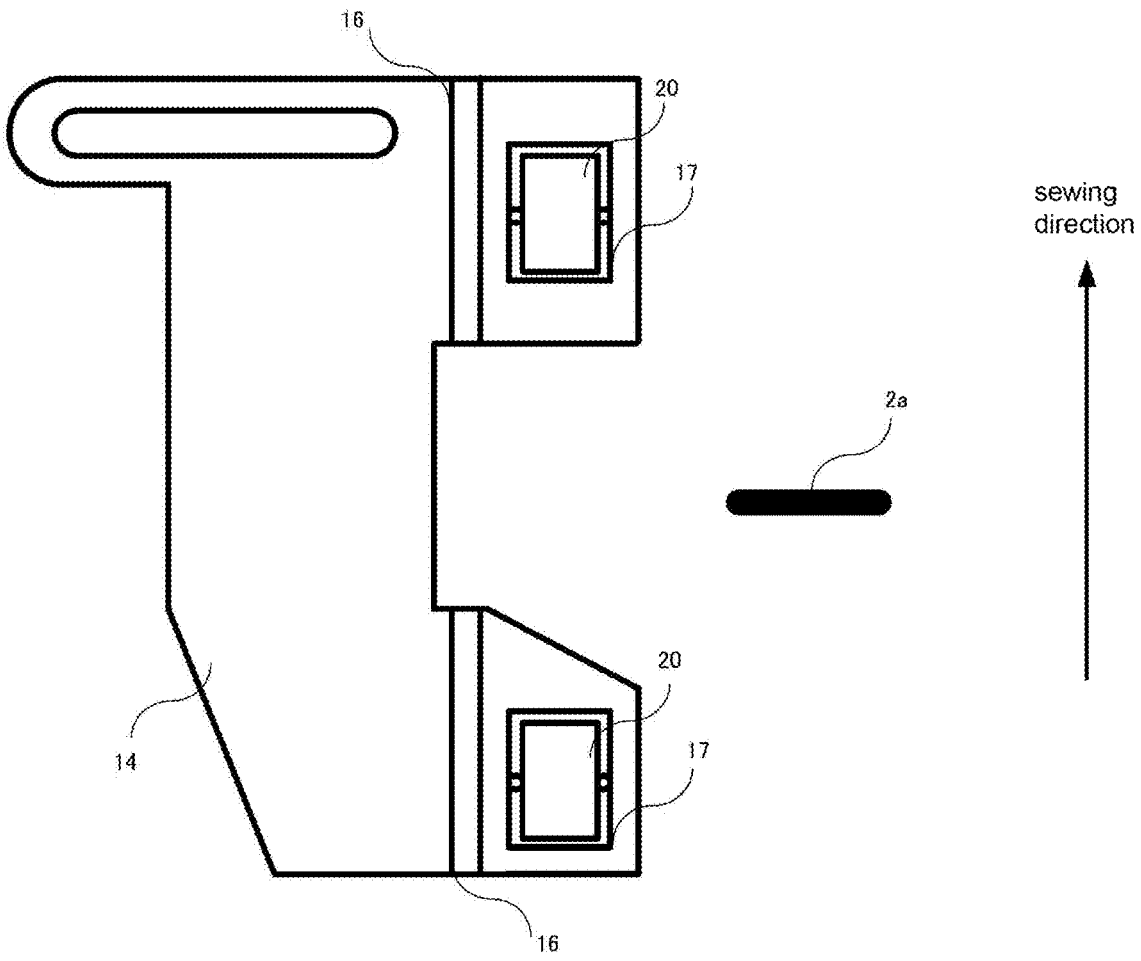
FIGS. 3A and 3B are drawings showing a configuration of a fabric guide of the first embodiment.
Figure 3B:
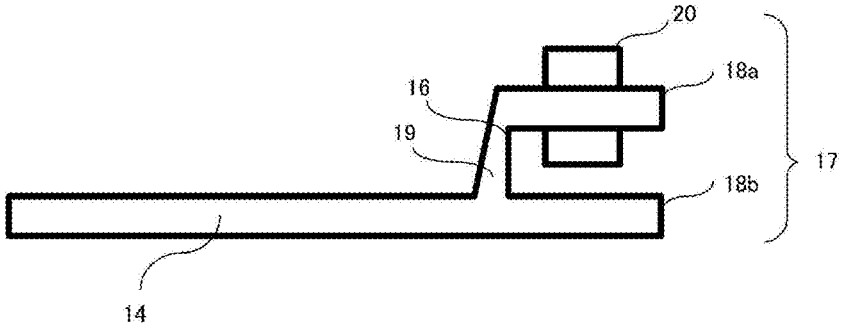

FIG. 3A is a plan view and FIG. 3B is a front view showing an entire fabric guide 14. As shown in FIG. 3A, the fabric guide 14 has a guide portion 16 which serves as a basis when the fabric 100 is moved in the width direction of the pattern and a holding portion 17 which holds the fabric 100. Namely, the fabric guide 14 abuts on the fabric 100 to guide the cloth feeding in the sewing direction, and holds the fabric 100.

As shown in FIG. 3B, a part of the cross section of the fabric guide 14 is comprised of two sides 18*a*, 18*b* which face to the fabric 100 placed along the guide portion 16 from above and below, and a side 19 which connects the two sides 18*a*, 18*b* with each other. The side 19 is perpendicular to the sides 18*a*, 18*b*. A vertical surface of the side 19 serves as the guide portion 16. The guide portion 16 extends in one direction. When the fabric guide 14 is attached to the carriage 10, the guide portion 16 extends in the sewing direction. When the fabric 100 is held by the holding portion 17, the vertical surface (guide portion 16) functions as a partition against the fabric 100. The fabric 100 is held so that an end surface of the fabric 100 is always laid along the guide portion 16 when sewing the fabric 100.

The holding portion 17 is comprised of: two sides 18*a*, 18*b* which face to the fabric 100 from above and below; a side 19 which connects the two sides 18*a*, 18*b* with each other; and a pressing roller 20 formed on the upper side 18*a*. Namely, a rotation axis of the pressing roller 20 is orthogonal to a feeding direction of the feed dog 2*a* and rotated in the feeding direction of the feed dog 2*a*. An interval between the lower side 18*b* and the pressing roller 20 is specified to be narrower than a thickness of the fabric 100. Since the pressing roller 20 presses the fabric 100, the fabric 100 can be surely held. Namely, the lower side 18*b* and the pressing roller 20 sandwich the fabric 100. In addition, an axis of the pressing roller 20 can be specified to be movable in the vertical direction, and the pressing force applied to the fabric 100 can be adjustable by an elastic member. The fabric 100 is moved together with the holding portion 17. Thus, the fabric 100 is not required to be moved by hand.

(Configuration of Controller)

Figure 4:
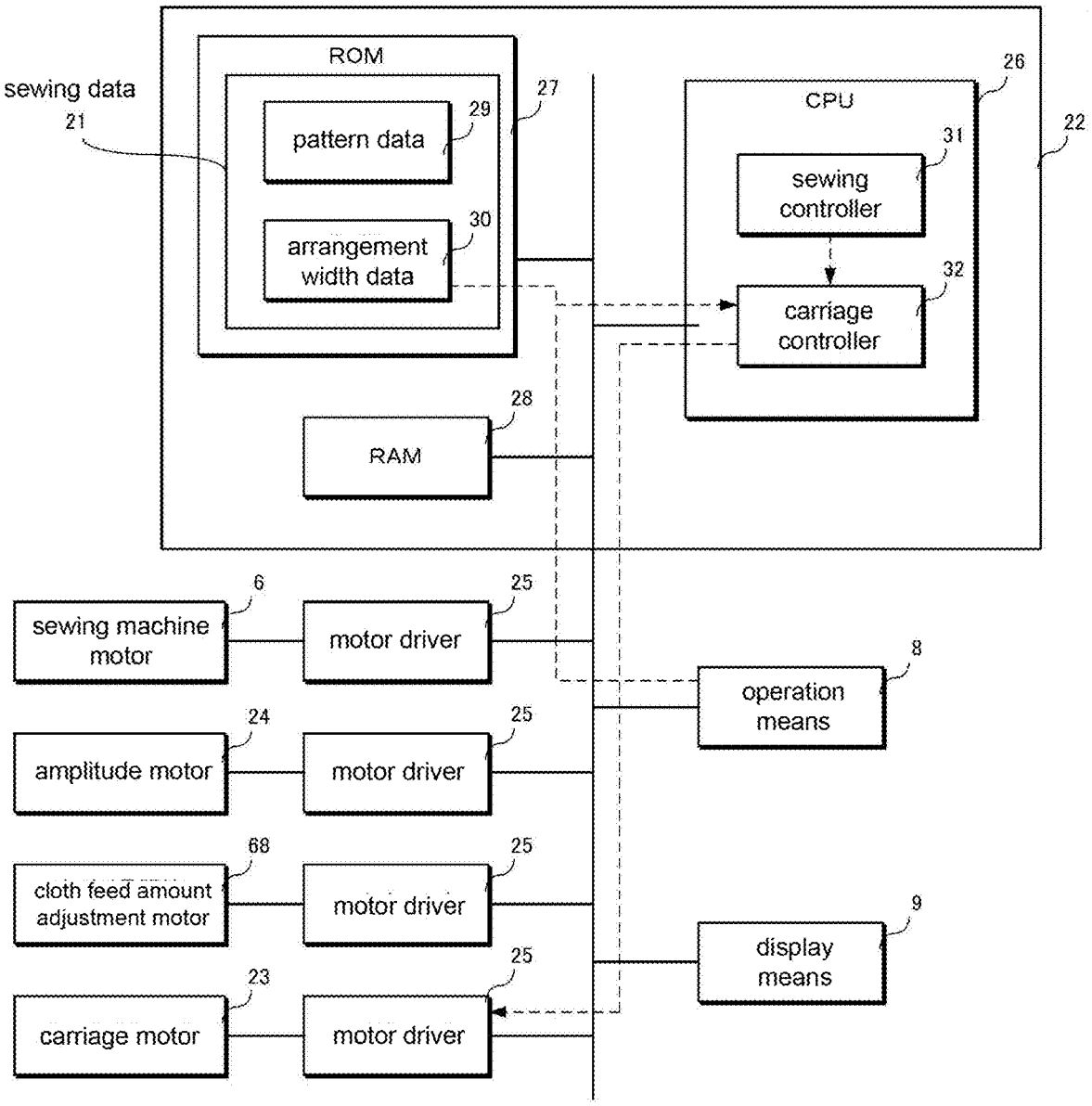
FIG. 4 is a block diagram showing a functional configuration of the sewing machine of the first embodiment.

The carriage 10 for driving the fabric guide 14 is controlled by a computer 22 provided on the sewing machine 1. FIG. 4 is a block diagram showing a control configuration of the sewing machine 1. The sewing machine 1 is comprised of: a computer 22 served as a controller: a carriage motor 23 served as a power source of the carriage 10; a sewing machine motor 6 served as a power source of driving the needle bar 3*a* vertically and a power source of a hook 5; an amplitude motor 24 served as a power source of swinging the needle bar 3*a* to right and left; a cloth feed amount adjustment motor 68 served as a power source of driving a cam for adjusting the cloth feed amount fed by the feed dog 2*a*; motor drivers 25 of each motor; and an operation means 8 served as an input interface for receiving input from the user.

The computer 22 is comprised of a CPU 26, a ROM 27 and a RAM 28. The ROM 27 stores a sewing program and sewing data 21. By executing a sewing program, the sewing machine 1 performs sewing. The sewing data 21 includes a pattern data 29 and an arrangement width data 30.

Figure 5:
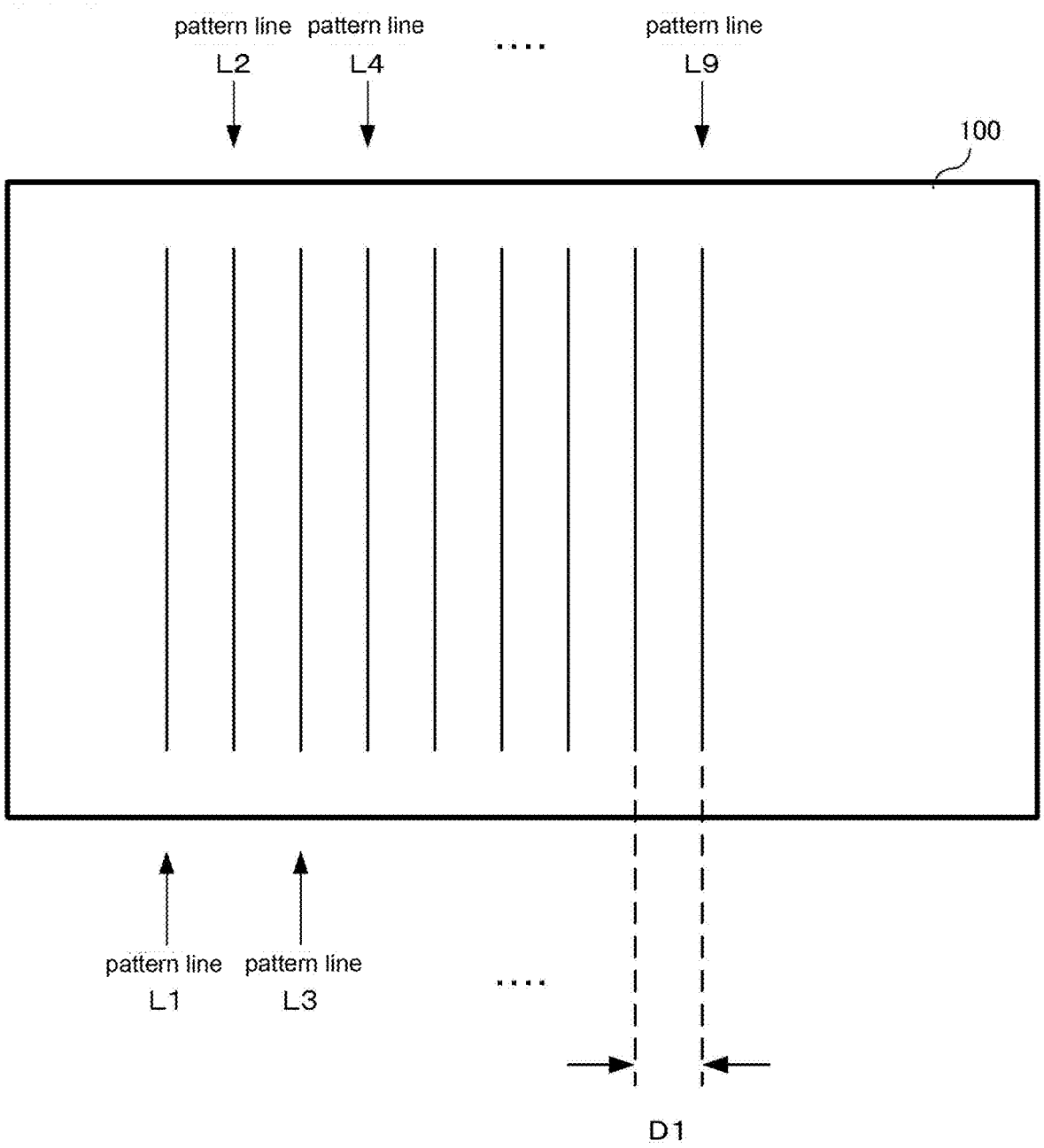
FIG. 5 is a drawing showing an example of a pattern sewn by the sewing machine of the first embodiment.

The pattern data 29 is a data including a needle location coordinate and the number of needles, both required for sewing the pattern. When the pattern is formed by a plurality of pattern lines, the needle location coordinate of each of the pattern lines is stored. Each of the pattern lines extends in the sewing direction. The arrangement width data 30 is a data indicating an interval (clearance) between the pattern lines. The arrangement width data 30 is set for each interval between the pattern line and the pattern line. All the arrangement widths between the pattern lines can be set to be equal. Alternatively, the arrangement widths between the pattern lines can be set to be different with each other. FIG. 5 is a drawing showing an example of the pattern sewn by the sewing machine 1 of the present embodiment. The pattern shown in FIG. 5 is formed by arranging nine pattern lines. The arrangement width between the pattern lines L1 to L9 is a distance D1. Namely, the pattern lines L1 to L9 are arranged at an interval of the distance D1. In the pattern shown in FIG. 5, the pattern data 29 includes the needle location coordinate required for sewing the pattern lines L1 to L9. In addition, the arrangement width data 30 includes the distance D1 which is uniformly set as the arrangement width for all pattern lines L1 to L9.

The CPU 26 realizes a sewing controller 31 and a carriage controller 32 by executing the sewing program stored in the ROM 27. The sewing controller 31 reads the needle location coordinate included in the pattern data 29, and calculates control amounts of the sewing machine motor 6, the cloth feed amount adjustment motor 68 and the amplitude motor. The sewing controller 31 outputs control command including the calculated control amounts to each of the motor drivers 25. Each of the motor drivers 25 drives each motor based on the control command. When the sewing of each of the pattern lines is finished, the sewing controller 31 raises a presser foot 62 which presses the fabric 100. The sewing controller 31 outputs a signal of the end of sewing to the carriage controller 32.

The carriage controller 32 reads the arrangement width data 30 and calculates a control amount of the carriage motor 23. The control amount is, for example, a rotation amount of the motor for driving the fabric guide 14 by the arrangement width between the pattern lines indicated by the arrangement width data 30. The carriage controller 32 outputs the control command including the calculated control amount of the carriage motor 23 to the motor drivers 25. The motor drivers 25 drive the carriage motor 23 based on the control command. The carriage controller 32 receives the signal of the end of sewing output from the sewing controller 31. In addition, the carriage controller 32 receives the signal from the fabric guide moving keys. The fabric guide moving keys are buttons displayed on the touch panel 91. When the carriage controller 32 receives the signal from the fabric guide moving keys, the carriage controller 32 outputs the control command including the preliminarily specified control amount to the motor drivers 25. Namely, the carriage controller 32 controls the carriage motor 23 by two control signals.

(Control Example of Carriage)

(a) Example of Movement of Fabric Guide Based on Arrangement Width Data 30

Figure 6:
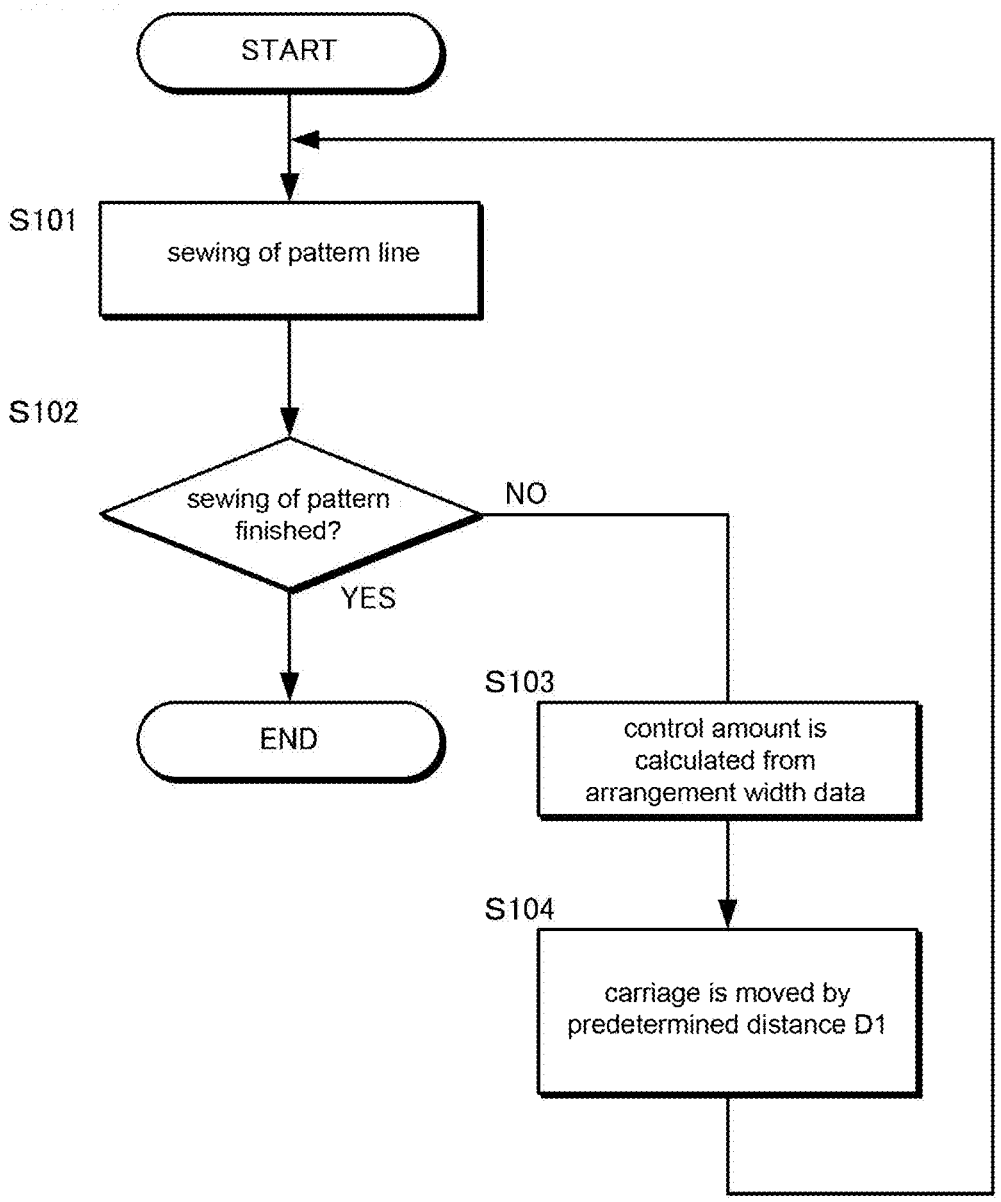
FIG. 6 is a flowchart showing a control operation of the carriage in the sewing machine of the first embodiment.

FIG. 6 is a flowchart showing a control operation of the carriage 10. First, sewing of the first pattern line is performed (S101). If the pattern is completed after the sewing of the first pattern line, the sewing of the pattern is finished (YES in S102). On the other hand, if the pattern is not completed (NO in S102), the carriage controller 32 reads the arrangement width data 30 and calculates the control amount of the carriage motor 23. The arrangement width data 30 read here is the arrangement width (distance D1) between the first and second pattern lines (S103). Then, the carriage controller 32 controls the carriage motor 23 to extend or contract the carriage 10 in the amplitude direction of the needle by the distance D1 (S104). The carriage 10 is moved after receiving the signal of the end of sewing from the sewing controller 31.

Then, sewing of the second pattern line is performed. When the third pattern line is sewn after the sewing of the second pattern line, the carriage controller 32 newly reads the arrangement width data 30 between the second and the third pattern lines and calculates the control amount of the carriage motor 23. Then, sewing of the next (third) pattern line is performed. The above described procedures are repeated until the pattern is completed. When the arrangement widths of the pattern lines are equal to each other, there is no need to newly calculate the control amount.

(b) Movement of Fabric Guide 14 According to Input of User

The user operates the fabric guide moving keys for adjusting the position of the fabric 100. The carriage controller 32 outputs the control signal to the motor driver 25 of the carriage motor 23 based on the signal generated by pressing the fabric guide moving keys. The motor driver 25 drives the carriage motor 23 based on the control command. Because of this, the fabric 100 is moved together with the carriage motor 23.

[1-2. Operations]

Hereafter, procedures of sewing an embroidery of the pattern using the sewing machine 1 of the present embodiment will be explained. For the purpose of explanation, the pattern shown in FIG. 5 is used as the completed pattern. The pattern is sewn on the left end side of the fabric 100. The sewing is performed sequentially from the pattern line of the left side to the pattern line of the right side. In the pattern shown in FIG. 5, nine pattern lines are sewn at the equal distance D1. The sewing machine 1 performs sewing of each of the pattern lines by sliding the fabric guide 14 by the distance D1 each. FIGS. 7A to 7H are drawings showing a procedure of sewing the pattern of FIG. 5.

First, as a preparatory stage of sewing the pattern, the fabric guide 14 is fixed to the carriage 10. When the pattern is sewn on the left end side of the fabric 100, the fabric guide 14 is fixed to the fixing portion 12*a*. The guide portion 16 of the fabric guide 14 is fixed so as to be paralleled to the sewing direction of the pattern.

Figure 7A:
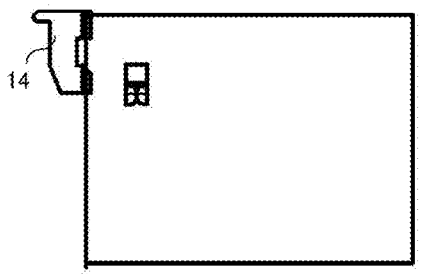
FIGS. 7A to 7H are schematic views showing a procedure of sewing the pattern in the first embodiment.

The user arranges the fabric 100 on the fabric guide 14 so that the left end portion of the fabric 100 extends along the guide portion 16. The fabric 100 is pressed by the pressing roller 20 and fixed to the fabric guide 14. Accordingly, even when the fabric guide 14 is slid in the amplitude direction of the needle, a relative position between the fabric guide 14 and the fabric 100 is not changed. When the fabric guide 14 is slid, the fabric 100 is not displaced in the amplitude direction of the needle with respect to the fabric guide 14. Thus, the left end portion of the fabric 100 is held in a state along the guide portion 16. Then, the user operates the touch panel 91 to select the pattern to be sewn. Thus, the preparation for sewing the pattern is finished (FIG. 7A).

The sewing of the pattern is started when the user operates the tact switch 81 for starting the sewing. By receiving the signal from the tact switch 81, the sewing controller 31 drives the sewing machine motor 6, the cloth feed amount adjustment motor 68 and the amplitude motor 24 based on the pattern data 29 of the first pattern line. Because of this, the cloth feed in the sewing direction is started by the feed dog 2*a*, and the forming of the seams is started by the needle 3 and the hook.

Figure 7B:
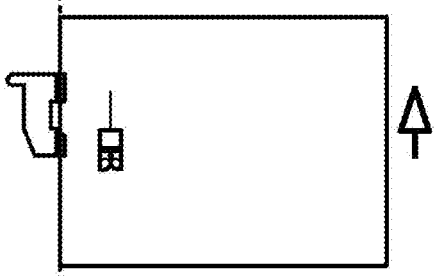

By the driving force of the sewing machine motor 6, the feed dog 2*a* is operated. By the operation of the feed dog 2*a*, whole the fabric 100 is fed in the sewing direction. At that time, the fabric 100 located near the fabric guide 14 is also fed in the sewing direction by the operation of the feed dog 2*a*. In the fabric guide 14, the pressing roller 20 is rotated in accordance with movement of the fabric 100 in the sewing direction. Accordingly, the force of pressing the fabric 100 by the pressing roller 20 does not cause large resistance for the cloth feed in the sewing direction. In addition, when feeding the fabric 100 in the sewing direction, the user can assist the cloth feed. For example, the user can put the right hand on the right end portion of the fabric 100. Thus, the user can move the right hand according to the speed of the cloth feed of the fabric 100 in the sewing direction by the feed dog 2*a*. By doing so, the fabric 100 can be precisely fed in the sewing direction (FIG. 7B).

Figure 7C:
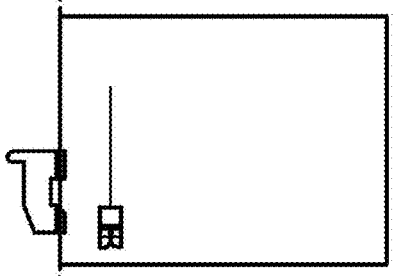

When the seams are formed until the number of needles stored in the pattern data 29, the sewing controller 31 stops the motor for driving the feed dog 2*a*, the needle bar 3*a* and the hook. Since the rotation of the feed dog 2*a* is stopped, the cloth feed of the fabric 100 in the sewing direction is also stopped. Because of this, the sewing of the first pattern line is finished. Then, the sewing controller 31 raises the presser foot 62. When the presser foot 62 is raised, only the holding portion 17 holds the fabric 100 (FIG. 7C).

Then, the fabric 100 is fed in the amplitude direction of the needle by a predetermined distance D1. When the sewing of the first pattern line is finished, the sewing controller 31 outputs the signal of the end of sewing to the carriage controller 32. When the carriage controller 32 receives the signal, the carriage controller 32 reads the arrangement width between the first and second pattern lines from the arrangement width data 30. Then, the control amount of the carriage motor 23 is calculated based on the arrangement width. The calculated control amount is a value for moving the carriage 10 to the left direction by the distance D1. Then, the carriage controller 32 rotates the carriage motor 23 based on the calculated control amount. In this case, the rotation direction of the carriage motor 23 is a direction of extending the carriage 10. By the driving force of the carriage motor 23, the carriage 10 is extended by the predetermined distance D1. When the carriage 10 is extended, the fabric guide 14 is slid in the left direction precisely by the predetermined distance D1. Because of this, the fabric guide 14 is also slid to the left side, which is a direction separating from a needle location point, precisely by the predetermined distance D1.

Figure 7D:
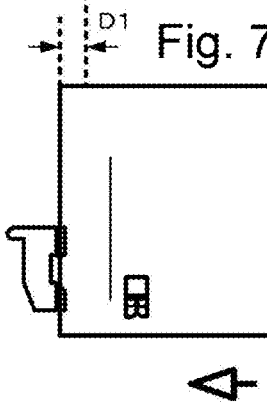

In accordance with the movement of the fabric guide 14, the guide portion 16 is also moved to the left side by the predetermined distance D1. The fabric 100 is moved together with the guide portion 16 to the left side by the predetermined distance D1. Because of this, the needle location point to the fabric 100 is displaced in the amplitude direction of the needle by the predetermined distance D1. At that time, the fabric 100 is moved to the left side while the left end portion of the fabric 100 is held by the holding portion 17 of the fabric guide 14. Since the fabric 100 is moved so as to be pulled by the fabric guide 14, wrinkles are hardly formed on the fabric 100 by the cloth feed in the lateral direction (FIG. 7D).

Figure 7E:
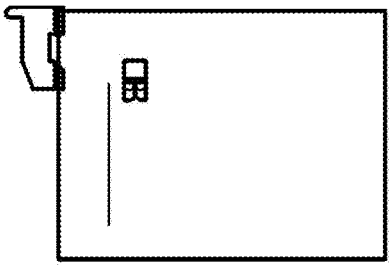

Then, the fabric 100 is fed in the sewing direction to adjust a sewing position of the second pattern line. The user moves the fabric 100 in the sewing direction while the left end surface of the fabric 100 is aligned along the guide portion 16 based on visual confirmation. The distance of moving the fabric 100 is equal to the distance of the cloth feed in the sewing direction when sewing the first pattern line. Because of this, the fabric 100 can be precisely moved to the sewing position of the second pattern line (FIG. 7E).

Figure 7F:
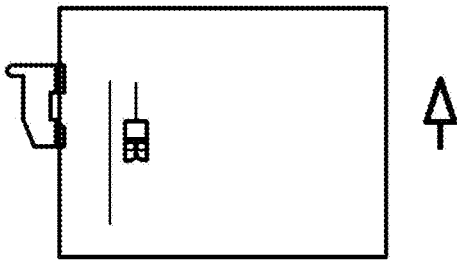
Figure 7G:
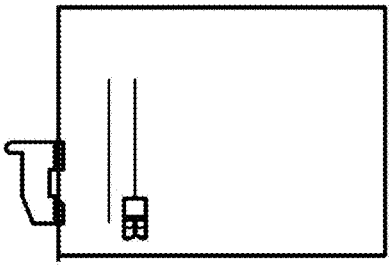

Then, sewing of the second pattern line is started. The sewing of the second pattern line is performed in the same manner as the sewing of the first pattern line. Namely, when the sewing is started, the sewing controller 31 reads the pattern data 29 of the second pattern line and controls each of the motors (FIGS. 7F to 7G). When the seams are formed until the number of needles stored in the pattern data 29, the sewing of the second pattern line is finished.

Figure 7H:
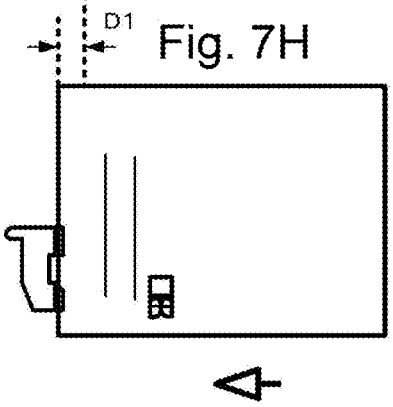

When the sewing of the second pattern line is finished, the carriage controller 32 calls the arrangement width between the second and third pattern lines and calculates the control amount of the carriage motor 23. Then, the carriage controller 32 controls the carriage motor 23 based on the calculated control amount. The carriage motor 23 extends the carriage 10 by the predetermined distance to precisely slide the fabric guide 14 by the predetermined distance. Even after the guide portion 16 of the fabric guide 14 is slid, the fabric 100 is held on the fabric guide 14 while the fabric 100 is aligned along the guide portion 16. Accordingly, the needle location point to the fabric 100 is precisely displaced by the predetermined distance D1 (FIG. 7H). By repeating the above descried processes, the pattern is sewn.

[1-3. Effects]

In the above described sewing machine 1 for sewing the pattern having a certain size both in the sewing direction and the amplitude direction of the needle on the fabric according to the sewing data 21, sewing of the pattern is preformed while feeding the fabric 100 in the sewing direction by the feed dog 2*a*. The sewing machine 1 has the fabric guide 14. The fabric guide 14 has the guide portion 16 extending straight in the sewing direction to serve as a basis when fabric 100 is fed in the amplitude direction of the needle. The carriage 10 slides the fabric guide 14 in the amplitude direction of the needle by the predetermined distance each. Because of this, the guide portion 16 serves as an indicator of the position of the fabric 100 for sewing the next pattern line. Accordingly, the fabric 100 can be located precisely for sewing the next pattern line. Thus, high-quality pattern can be sewn.

In the present embodiment, the holding portion 17 is provided on the fabric guide 14 to move the fabric 100 together with the slide of the fabric guide 14. However, only the guide portion 16 can be provided on the fabric guide 14. In this case, when the fabric guide 14 is slid for sewing the next pattern line by the predetermined distance, the user moves the fabric 100 so that the fabric 100 is aligned along the guide portion 16 by hand. Also in this case, the guide portion 16 serves as an indicator of the position of the fabric 100 for sewing the next pattern line. Accordingly, the fabric 100 can be located precisely for sewing the next pattern line. Thus, high-quality pattern can be sewn.

The fabric guide 14 of the present embodiment has the holding portion 17 for holding the fabric 100 which is abutted on the guide portion 16. The holding portions holds the fabric 100 and slides the fabric 100 by the predetermined distance each. Because of this, manual work of the user is eliminated by automatically sliding the fabric 100 in the amplitude direction of the needle. Accordingly, the position can be more precisely located and high-quality pattern can be sewn.

The holding portion 17 of the present invention includes the pressing roller 20 which presses the fabric 100 and rotates in the sewing direction. Because of this, resistance of the fabric 100 is reduced when feeding the fabric 100 in the sewing direction. Accordingly, the fabric 100 can be precisely fed also in the sewing direction and high-quality pattern can be sewn.

In the present embodiment, as the arrangement width data 30 included in the sewing data 21, the intervals between the pattern lines are uniformly set to the distance D1. By controlling the carriage based on the sewing data 21, the fabric guide can be slid by the predetermined distance D1 each. Because of this, high-quality pattern having the constant arrangement width between the pattern lines can be sewn. In the present embodiment, as the arrangement width data 30, the intervals between the pattern lines are uniformly set to the distance D1. However, the intervals between the pattern lines can be specified to be different with each other. By specifying the intervals between the pattern lines with each other, the pattern formed by the pattern lines which are arranged by various arrangement widths can be sewn.

In the present embodiment, the number of needles required for completion of the pattern is included in the pattern data 29. Because of this, when the number of needles reaches to the scheduled number, the sewing machine 1 automatically stops sewing of the pattern lines. Accordingly, the pattern is not sewn exceeding the required number of needles and high-quality pattern can be sewn. On the other hand, the data of the number of needles is not necessarily included in the pattern data 29. In this case, the sewing of the first pattern line is finished at an arbitrary number of needles by the user and the number of needles is stored. When sewing the second pattern line, the sewing can be continued until the stored number of needles. Because of this, the sewing can be performed without determining the length of the pattern in advance. Accordingly, when sewing the second and the following pattern lines, the sewing is automatically finished when the number of needles reaches to the number stored in the first pattern line. Thus, high-quality pattern can be sewn.

In the present embodiment, the pattern lines are formed only by the pattern of straight lines. Alternatively, the pattern lines can be formed by a plurality of object patterns. Since the guide portion 16 serves as an indicator of the position of the fabric 100 for sewing the next pattern line, high-quality pattern can be sewn regardless of the pattern forming the pattern lines.

The pressing roller 20 of the present embodiment is rotated in accordance with the movement of the fabric 100 in the sewing direction. Alternatively, the pressing roller 20 can be actively rotated in accordance with the cloth feed amount of the fabric 100.

2. Second Embodiment

The pattern lines of the pattern sewn by the sewing machine 1 of the present embodiment is formed by the object pattern. The arrangement width between the pattern lines is equal to the width of the object pattern. The sewing machine 1 makes the sewing data of the pattern so that the width of the object pattern is equal to the arrangement width between the pattern lines. In the sewing machine 1, the predetermined distance to slide the fabric guide 14 based on the sewing data 21 is matched with the width of the object pattern.

Figure 8:
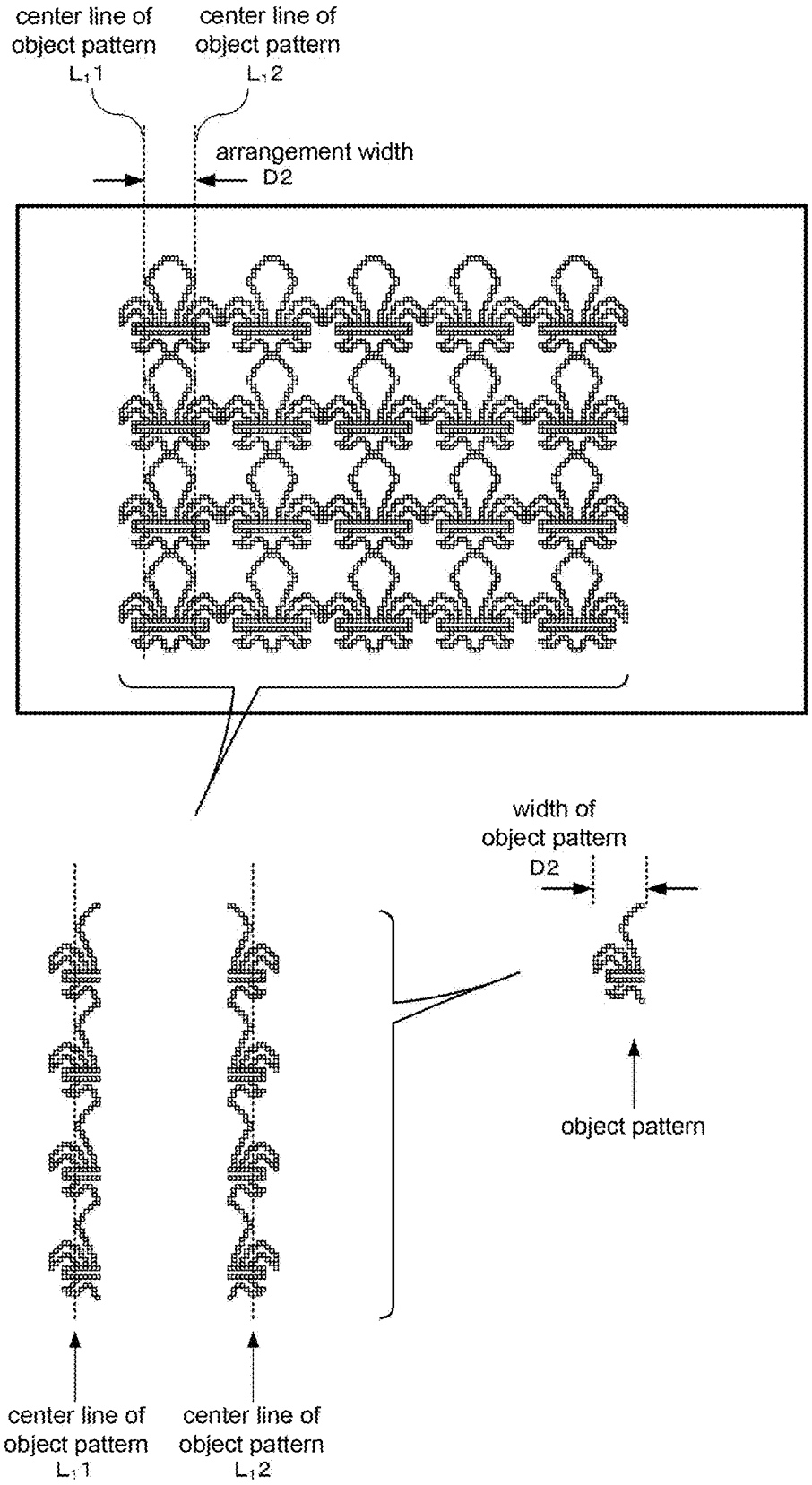
FIG. 8 is a drawing showing an example of a pattern sewn by the sewing machine of the second embodiment.

FIG. 8 is a drawing showing an example of the pattern sewn by the sewing machine of the present embodiment. The pattern shown in FIG. 8 is formed by ten pattern lines. Each of the pattern lines is formed by four object patterns. The width of the object pattern is a distance D2, and the arrangement width between the pattern lines is the distance D2. In addition, the distance D2 is equal to or less than the maximum amplitude Amax of the needle 3. Here, the object pattern has a width equal to or less than the amplitude of the needle 3 in the sewing machine 1. Further, from the beginning to the end of the sewing, the user doesn't have to cut a thread and move the fabric 100 in the amplitude direction of the needle by hand. When the pattern lines are formed by the object pattern, the arrangement width between the pattern lines is calculated based on a distance between center lines L1 of the object patterns forming the pattern lines. The center line L1 of the object pattern is a line extending in the sewing direction of the pattern. The center line L1 passes through the center of the object pattern in the amplitude direction of the needle. Namely, the center line L1 divides the object pattern into two equal parts in the amplitude direction of the needle.

In FIG. 8, the width of the object pattern and the arrangement width between the pattern lines are both D2 and equal to each other. Accordingly, the object patterns of the neighboring pattern lines are in contact with each other. In the above described pattern, even if one of the object patterns is displaced, the appearance is affected. Hence, high precision is required for the cloth feed in the amplitude direction of the needle based on the fabric guide 14.

[2-1. Configuration]

Figure 9:
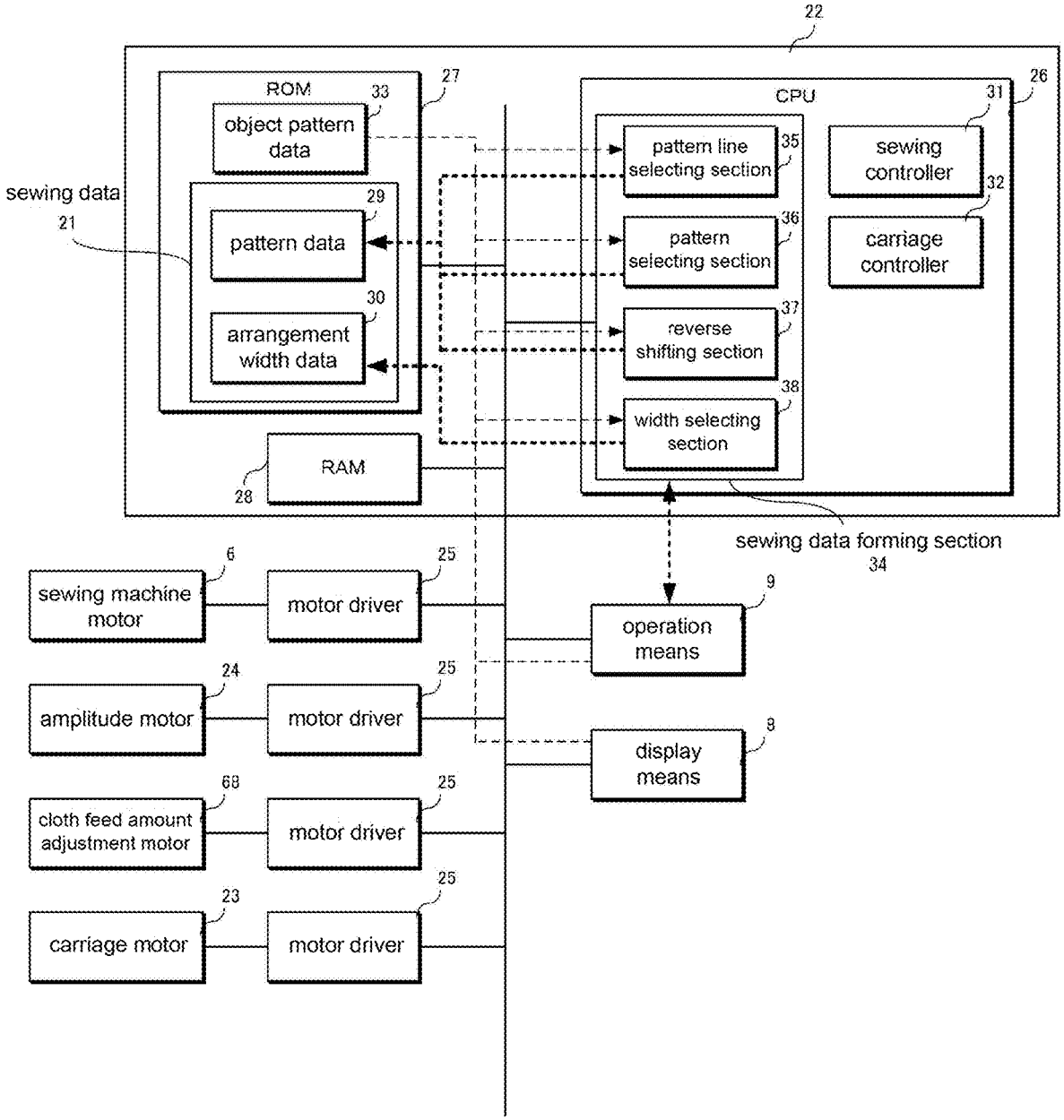
FIG. 9 is a block diagram showing a functional configuration of the sewing machine of the second embodiment.

FIG. 9 is a block diagram showing a control configuration of the sewing machine of the present embodiment. In the present embodiment, in addition to the configuration of the sewing machine 1 of the first embodiment, the configuration required for making the sewing data 21 where the width of the object pattern forming each of the pattern lines and the arrangement width between the pattern lines are equal are added. Note that the same reference numerals are added to the same configuration common with the first embodiment to avoid duplicate explanation.

(Configuration of Controller)

The control for making the sewing data 21 is achieved by the computer equipped with the sewing machine 1. As shown in FIG. 9, the ROM 27 of the computer 22 stores a sewing data forming program for making the sewing data 21 and an object pattern data 33 in addition to the sewing program and the sewing data 21.

A plurality kinds of data of the object pattern is stored in the object pattern data 33. The stored data are the data including the needle location coordinate and the number of needles required for sewing each of the object patterns and the data of the width of the sewn object patterns. The width of the object pattern is equal to or less than the maximum amplitude Amax of the needle 3. In addition, the object pattern data 33 includes image data showing a state after sewing the object pattern to be displayed on the display means 9.

The CPU 26 achieves a sewing data forming section 34 by executing the sewing data forming program stored in the ROM 27. The sewing data forming section 34 displays a dialog for making the sewing data on the touch panel. Thus, the dialog prompts the user to select the number of pattern lines and the kind of the pattern. In addition, the sewing data forming section 34 receives the signal from the touch panel 91 which displays the dialog for making the sewing data. Then, the sewing data forming section 34 makes the sewing data 21 based on the received signal. In other words, the sewing data forming section 34 makes the sewing data 21 where the pattern is formed by the number of pattern lines selected by the user, the kind of the object pattern selected by the user, and the arrangement width equal to the selected width of the object pattern. The sewing data made by the sewing data forming section 34 is stored in the ROM 27.

The sewing data forming section 34 receives selection from the user about the following items.

(I) The number of pattern lines forming one pattern (II) The object pattern forming the pattern lines (III) The line numbers of the pattern lines for sewing the pattern by inversing the pattern of the basic pattern line.

(IV) The arrangement width between the pattern lines

The sewing data forming section 34 stores (I) to (IV) received from the user in the RAM 28 and makes the sewing data 21. The sewing data forming section 34 has a pattern line selecting section 35, a pattern selecting section 36, a reverse shifting section 37, and an arrangement width selecting section 38. Each section of the sewing data forming section 34 is connected to the touch panel 91 and the signal from the touch panel is input to each section.

The pattern line selecting section 35 receives selection from the user about the number of pattern lines forming one pattern. One pattern is formed by the received number of pattern lines received by the pattern line selecting section 35. The number of pattern lines received by the pattern line selecting section 35 is temporarily stored in the RAM 28.

The pattern selecting section 36 receives selection from the user about the object pattern forming the pattern lines. The user arbitrarily selects the object pattern from the object patterns stored in the object pattern data 33. The object patterns to be selected have the same width with each other. As the object pattern forming the pattern lines, one object pattern can be selected or a plurality of object patterns can be selected. Then, the pattern selecting section 36 reads the selected object pattern data from the object pattern data 33. The read object pattern data of the pattern line is temporarily stored in the RAM 28 while being associated with the data showing the line number of the pattern data of the object pattern.

The reverse shifting section 37 receives selection from the user about the line numbers of the pattern lines for sewing the pattern by inversing the pattern of the basic pattern line. Here, the basic pattern line is one of the pattern lines in the pattern, and the user arbitrarily selects the basic pattern line. For example, the pattern line arranged at the right end or the left end in the whole the pattern can be selected as the basic pattern line. When one pattern is sewn by arranging the pattern lines from right to left, the first pattern line counted from the right side can be selected as the basic pattern line. On the contrary, when the pattern is sewn by arranging the pattern lines from left to right, the first pattern line counted from the left side can be selected as the basic pattern line. When the user selects the pattern of a certain pattern line for sewing the pattern by inversing the pattern of the basic pattern line, the reverse shifting section 37 temporarily stores the line number of the pattern line for inversing the pattern in the RAM 28.

The arrangement width selecting section 38 can use the width of the object pattern selected by the pattern selecting section 36 as the arrangement width of the pattern lines. Alternatively, the arrangement width selecting section 38 can receive selection from the user about the arrangement width for each of the intervals between the pattern lines. In case the width of the object pattern is used as the arrangement width of the pattern lines, when the pattern selecting section 36 receives the selection of the object pattern forming the pattern lines, the arrangement width selecting section 38 reads the width of the selected object pattern from the object pattern data 33. Then, the width is temporarily stored in the RAM 28 as the arrangement width between the pattern lines.

(Display Example of Dialog)

Figure 10:
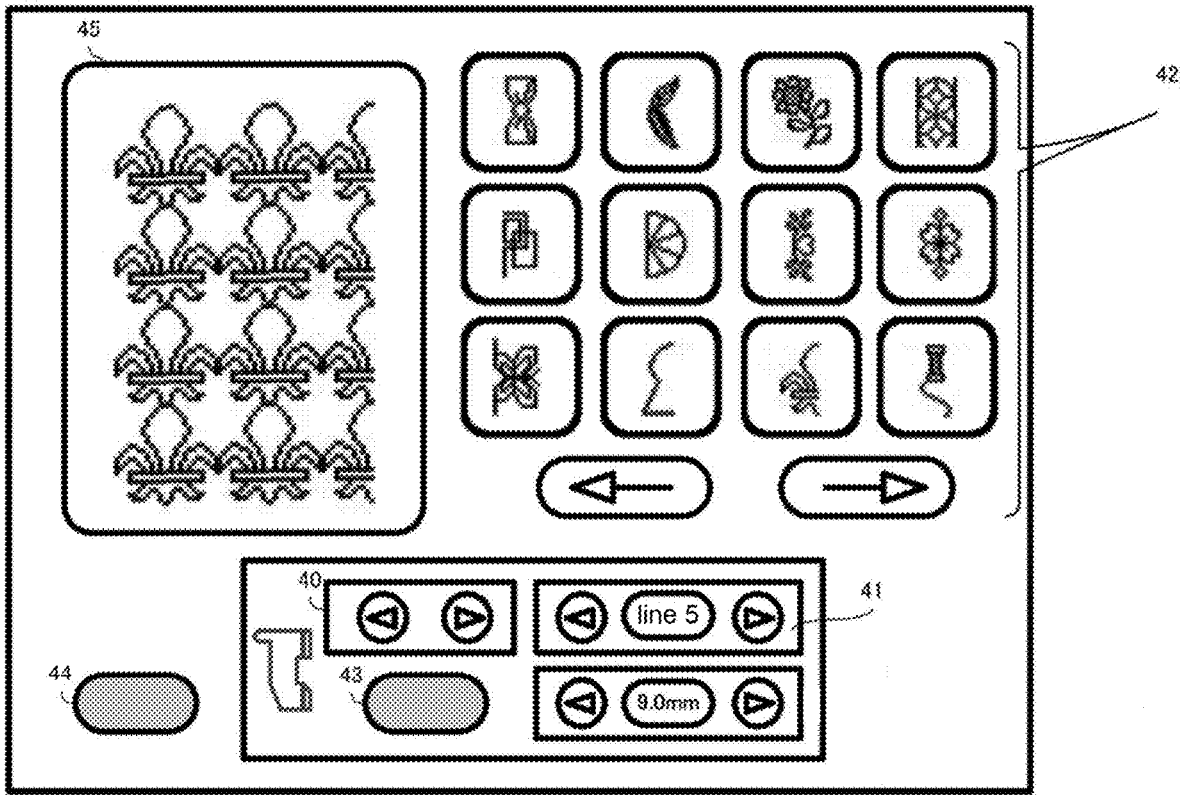
FIG. 10 is a screen configuration view showing a display example of a touch panel in the second embodiment.

FIG. 10 is an example of the dialog for making the sewing data to be displayed on the touch panel 91 by the sewing data forming section 34. The user selects the number of pattern lines forming the pattern, the pattern of the pattern lines, and the arrangement width between the pattern lines by operating various keys displayed on the dialog. The result of the selection is displayed on an edit box 45 as a completion predicted image. On the dialog for making the sewing data, fabric guide moving keys 40, pattern line selecting keys 41, pattern selecting keys 42, a reverse shifting key 43, an edit box 45 and a sewing data forming keys 44 are arranged.

The pattern line selecting keys 41 are keys for receiving selection from the user about the number of object patterns included in one pattern. The pattern selecting keys 42 are keys for selecting candidates of the object pattern forming the pattern lines. As shown in FIG. 10, the pattern selecting keys 42 can display twelve (3×4) candidates simultaneously. The reverse shifting key 43 is a button pressed when the pattern of a certain pattern line is selected to shift the pattern of the selected pattern line to the laterally inverted pattern of the basic pattern line. The edit box 45 is an area displaying the pattern selected by the pattern selecting keys 42. In addition, the result of the reversely shifted pattern by the reverse shifting key 43 is displayed. The sewing data forming key 44 is a button for letting the sewing data forming section 34 form the sewing data 21 based on the pattern displayed on the edit box 45.

(Control Example of Carriage)

Figure 11:
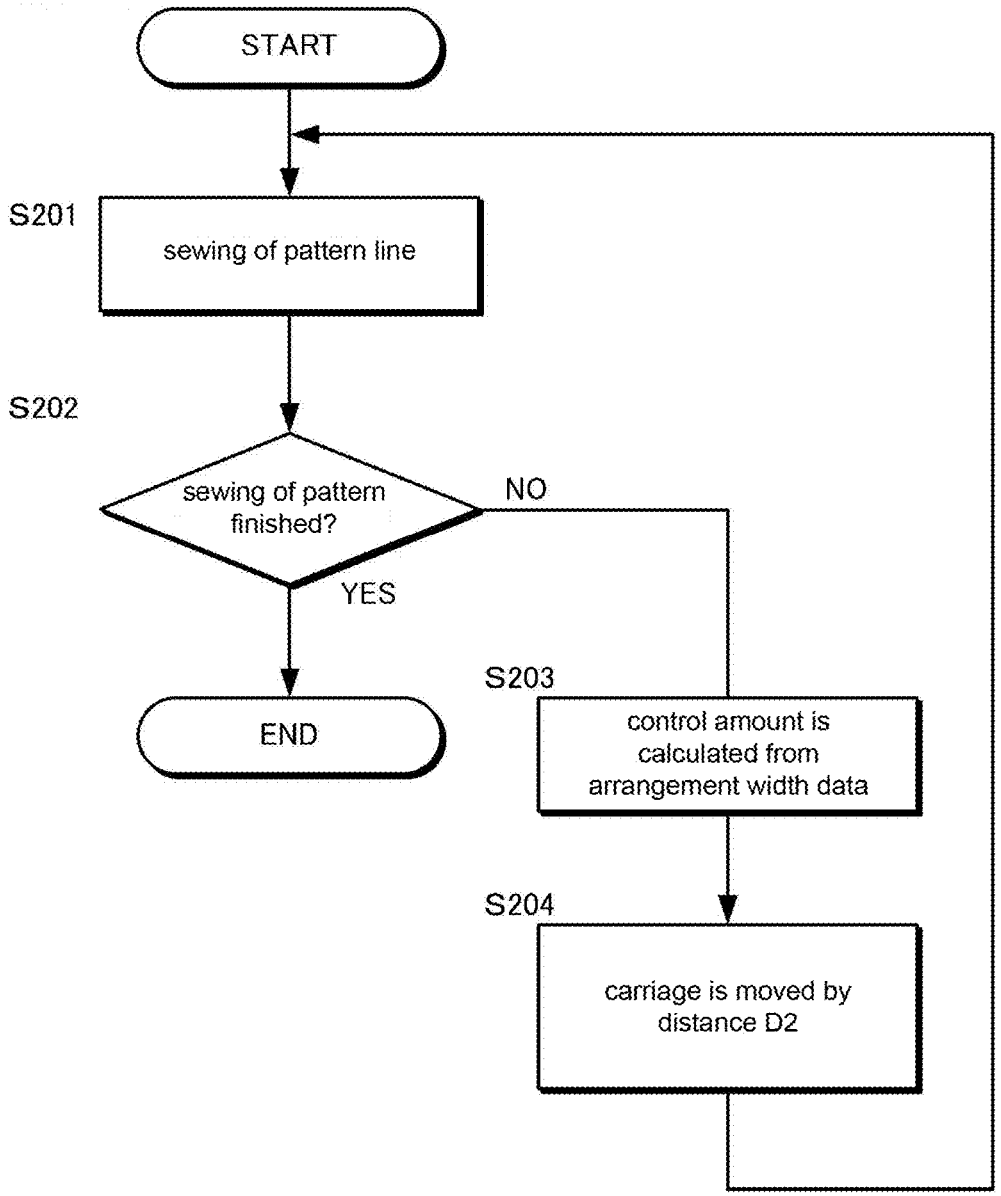
FIG. 11 is a flowchart showing a control operation of the carriage in the sewing machine of the second embodiment.

Hereafter, a control operation of moving the carriage 10 according to the width of the object pattern when sewing the pattern will be explained. FIG. 11 is a flowchart showing a control operation of the carriage 10.

First, the first pattern line is sewn (S201), and when the pattern is not completed (NO in S202), the carriage controller 32 reads an arrangement width D2 between the first and second pattern lines and calculates the control amount of the carriage motor 23 (S203). The calculated control amount is stored. Then, the carriage controller 32 controls the carriage motor 23 based on the calculated control amount to extend or contract the carriage 10 in the amplitude direction of the needle by the distance D2 (S204). The carriage 10 is moved after receiving the signal of the end of sewing from the sewing controller 31.

Then, the second pattern line is sewn. In case the third pattern line is further sewn, the carriage controller 32 controls the carriage motor 23 based on the preliminarily stored control amount to extend or contract the carriage 10 in the amplitude direction of the needle by the distance D2. Then, the next pattern line is sewn and these processes are repeated until the pattern is completed.

[2-2. Operations]

Hereafter, the procedure of sewing an embroidery of the pattern using the sewing machine of the present embodiment will be explained. For the purpose of explanation, the pattern shown in FIG. 8 is used as the completed pattern. The pattern is sewn on the left end side of the fabric 100. The sewing is performed sequentially from the pattern line of the left side to the pattern line of the right side. In the pattern shown in FIG. 8, ten pattern lines are sewn at the equal arrangement width D2. The sewing machine 1 performs sewing of each of the pattern lines by sliding the fabric guide 14 by the distance D2 each. FIG. 12A to 12H are drawings showing a procedure of sewing the pattern of FIG. 8.

First, as a preparatory stage of sewing the pattern, the fabric guide 14 is fixed to the carriage 10. The user arranges the fabric 100 on the fabric guide 14 so that the left end portion of the fabric 100 extends along the guide portion 16. Then, sewing is started when the tact switch 81 is operated. When the seams are formed until the number of needles stored in the pattern data 29, the sewing of the first pattern line is finished (FIGS. 12A to 12C).

When the sewing is finished, the carriage controller 32 calls the arrangement width D2 between the first and second pattern lines from the arrangement width data 30. Then, the control amount of the carriage motor 23 is calculated based on the arrangement width. The calculated control amount is a value for moving the carriage 10 to the left direction by the distance D2. By the driving force of the carriage motor 23, the carriage 10 is extended by a predetermined distance D2. In accordance with the extension of the carriage 10, the fabric guide 14 is slid to the left side precisely by the predetermined distance D2. In accordance with the movement of the fabric guide 14, the guide portion 16 is also moved to the left side by the predetermined distance D2. The fabric 100 is moved together with the guide portion 16 to the left side by the predetermined distance D2. Because of this, the needle location point to the fabric 100 is displaced in the amplitude direction of the needle by the predetermined distance D2 (FIG. 12D).

Figures 12A, 12B, 12C, 12D, 12E, 12F, 12G, 12H:
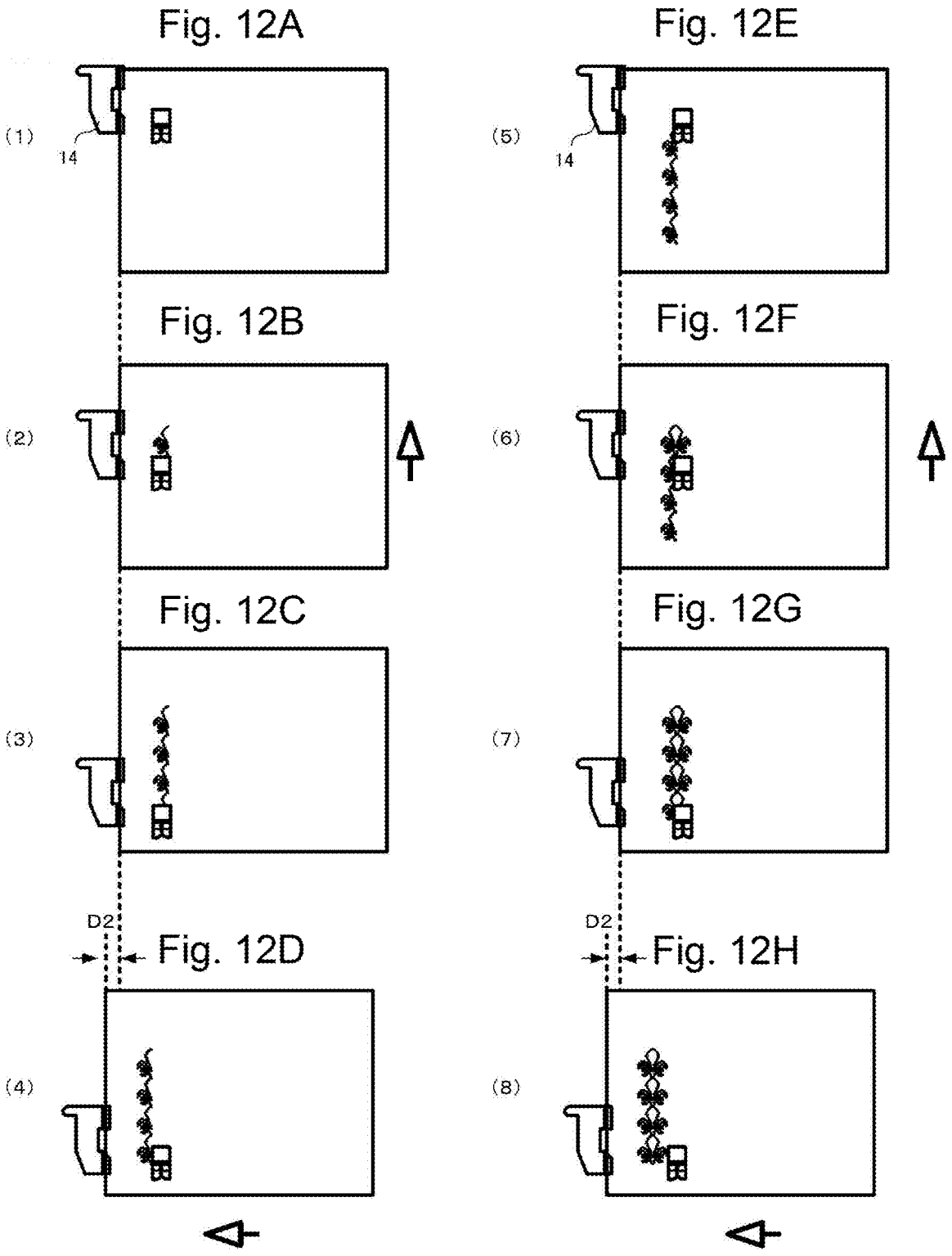
FIG. 12A to 12H are schematic views showing a procedure of sewing the pattern in the second embodiment.

Then, the fabric 100 is fed in the sewing direction to adjust a sewing position of the second pattern line and the second pattern line is sewn (FIGS. 12E to 12G). When the sewing of the second pattern line is finished, the carriage controller 32 controls the carriage motor 23 based on the calculated control amount. Because of this, the fabric guide 14 is slid precisely by the predetermined distance D2 and the fabric 100 is moved by the predetermined distance D2 (FIG. 12H). By repeating the above descried processes, the pattern is sewn.

[2-3. Effects]

In the above described embodiment, when an assembly of the object patterns having a width of equal to or less than the maximum amplitude Amax of the needle 3 is used for the pattern, the predetermined distance D2 is specified to be equal to the width of the object pattern. Because of this, in the pattern to be sewn, the object patterns are neighboring each other. Also in the above described pattern, the fabric 100 can be precisely located for sewing the next pattern line. Thus, high-quality pattern can be sewn.

Figure 13A:
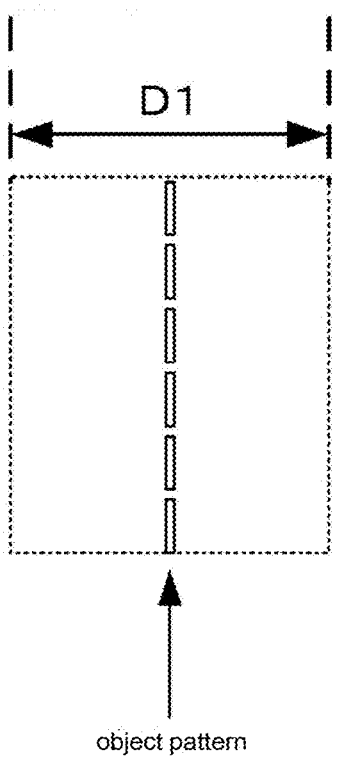
FIGS. 13A and 13B are drawings showing a variation example of an object pattern in the second embodiment.
Figure 13B:
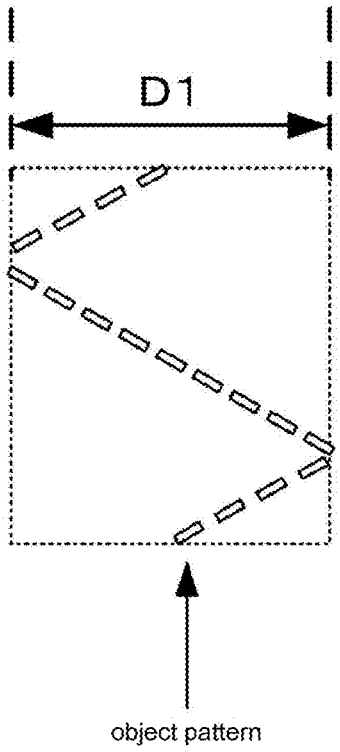

In addition, the pattern formed only by the pattern of straight lines shown in FIG. 5 can be also treated as the pattern where the pattern lines are formed by the object patterns. For example, FIG. 13A is a drawing showing the object pattern when the pattern lines of the pattern shown in FIG. 5 are formed by the object patterns. In the object pattern shown in FIG. 13A, the object pattern is formed by the seams extending in the sewing direction and left and right margins of the seams. In this case, the width of the object pattern is a total width of the left and right margins and the seams. Also in the above described pattern, the fabric 100 can be precisely located for sewing the next pattern line. Thus, high-quality pattern can be sewn. In addition, it is not necessary to form the object pattern only by the straight line extending in one direction. For example, as shown in FIG. 13B, one object pattern can be formed by a plurality of lines curved in a zigzag form.

The sewing machine 1 of the present embodiment has the sewing data forming section 34 which makes the sewing data 21 from a plurality of pattern lines. The sewing data forming section 34 has the pattern selecting section 36 and the arrangement width selecting section 38. The pattern selecting section 36 receives selection of an arbitrary object pattern forming the pattern lines from the object patterns having the same width. The arrangement width selecting section 38 specifies the selected width of the object pattern as the arrangement width between the pattern lines. Because of this, the sewing data 21 where the width of the object pattern forming the pattern lines is equal to the arrangement width between the pattern lines can be easily made. Also when the above described sewing data is used, the fabric 100 can be precisely located for sewing the next pattern line. Thus, high-quality pattern can be sewn.

Furthermore, the sewing data forming section 34 can have the reverse shifting section 37 to use the laterally inverted object pattern of the selected pattern line as the object pattern of the other pattern lines. Because of this, the sewing data 21 of the pattern formed by the same object patterns and the laterally inverted object patterns can be easily made.

Figure 14A:
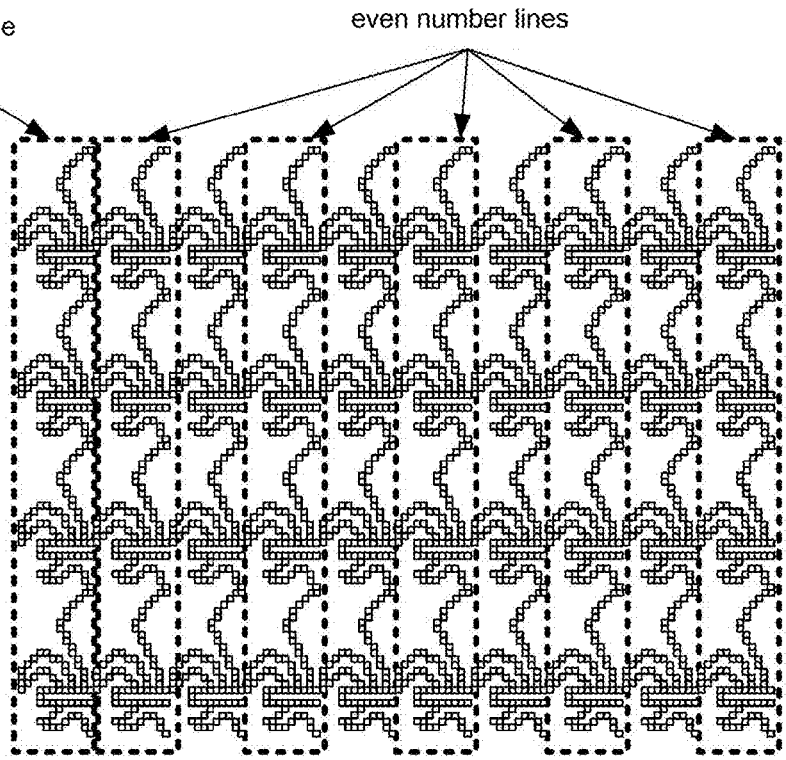
FIGS. 14A and 14B are drawings showing a procedure of making a pattern data in a variation example of the second embodiment.
Figure 14B:
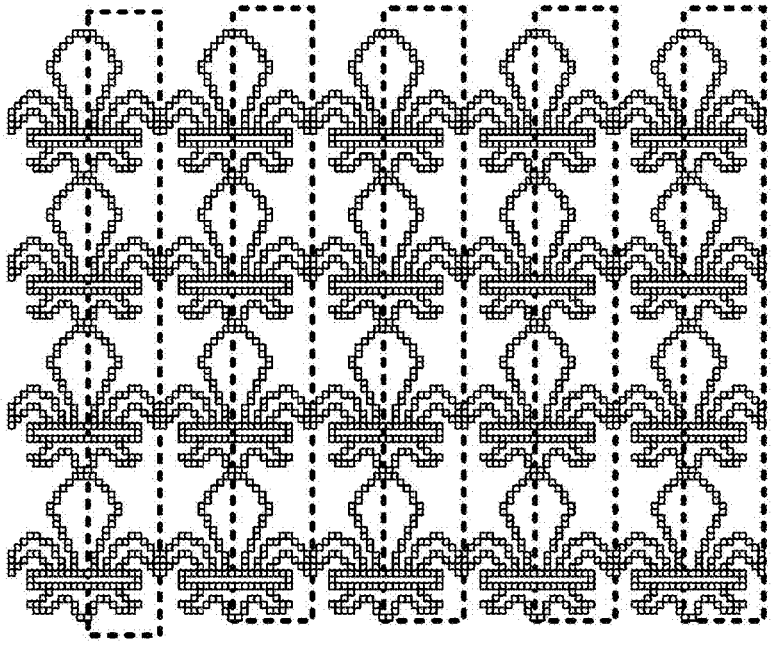

In the present embodiment, the pattern selecting section 36 receives from the user independently for each of the pattern lines. However, the configuration is not limited to this. For example, when one pattern is formed by the pattern lines of the same pattern, the selection can be received only for the pattern of the basic pattern line. In this case, the reverse shifting section 37 receives selection from the user whether or not the patterns of even number pattern lines are shifted to the laterally inverted patterns with respect to the pattern of the basic pattern line. FIG. 14A is a completion predicted image of the pattern displayed on the edit box 45 when four object patterns are selected as the pattern of the basic pattern line arranged at the end portion. In this state, if the signal from the user is input to the reverse shifting section 37, the reverse shifting section 37 shifts the patterns of the even number pattern lines to the laterally inverted patterns with respect to the pattern of the basic pattern line, as shown in FIG. 14B. Because of this, sewing pattern data can be made while reducing labor of the user for inputting.

In addition, the sewing data forming section 34 can make the sewing data 21 including all data of the needle location coordinate and the number of needles forming the pattern displayed on the edit box 45, the number of pattern lines forming whole the pattern, and the data of the widths between each of the pattern lines. However, the configuration is not limited to this. For example, the sewing data including the data of the needle location coordinate and the number of needles of one pattern line as the basic pattern line, the number of pattern lines forming whole the pattern, the data of the widths between each of the pattern lines, and the line number of the pattern lines for inversing shifting the pattern. In this case, the capacity of data can be suppressed as compared with the case where whole the pattern is included in the sewing data.

Furthermore, in the present embodiment, the basic pattern line in the reverse shifting section 37 is the pattern lines located at either the right end or left end of whole the pattern. Namely, the basic pattern line is only one. However, the number of the basic pattern line is not limited to one. A plurality of basic pattern lines can be specified. For example, when the pattern is formed by twelve pattern lines, the first pattern line and the seventh pattern line counted from the right side are specified as the basic pattern lines. The pattern of the first pattern line is referred to as a pattern A, the pattern of the seventh pattern line is referred to as a pattern B. In this case, the third and fifth lines are the patterns of the pattern A same as the pattern of the first line. The second, fourth and sixth lines are the patterns formed by laterally inverting the pattern of the pattern A. In addition, the ninth and eleventh lines are the patterns of the pattern B same as the pattern of the seventh line. The eighth, tenth and twelfth lines are the patterns formed by laterally inverting the pattern of the pattern B. Because of this, even when the pattern is formed by a plurality types of pattern lines, sewing pattern data can be made while reducing labor of the user for inputting.

In the present embodiment, when an assembly of the object patterns having a width of equal to or less than the maximum amplitude Amax of the needle 3 is used for the pattern, the predetermined distance D2 is specified to be equal to the width of the object pattern. However, the predetermined distance D2 is not limited to the above described configuration. For example, if the predetermined distance D2 is specified to be shorter than the width of the object pattern, neighboring pattern lines can be sewn while being overlapped with each other. In addition, if the widths between neighboring pattern lines are independently adjusted, gradation pattern can be sewn.

3. Third Embodiment

In the second embodiment, the carriage 10 is moved by the width of the object pattern D2 forming the pattern lines. In the present embodiment, the pattern is sewn by combining a plurality of object patterns having a width equal to or less than the maximum amplitude Amax of the needle 3 attached to the sewing machine 1 in the amplitude direction of the needle 3. The maximum amplitude Amax of the needle 3 is originally specified in the sewing machine. On the other hand, the width of the object pattern can be arbitrarily determined by the user. Accordingly, for example, when one pattern line is formed by the object pattern having a width equal to or less than a half of the maximum amplitude Amax of the needle 3 and the pattern line having the same width is neighboring to the above described pattern line to be in contact with each other, two pattern lines can be sewn only by the amplitude of the needle 3 without moving the carriage 10. In the sewing machine 1 of the present embodiment, based on the relationship between the width of the object pattern and the maximum amplitude Amax of the needle, movement of the carriage is reduced. Thus, high-quality pattern can be sewn.

Figure 15:
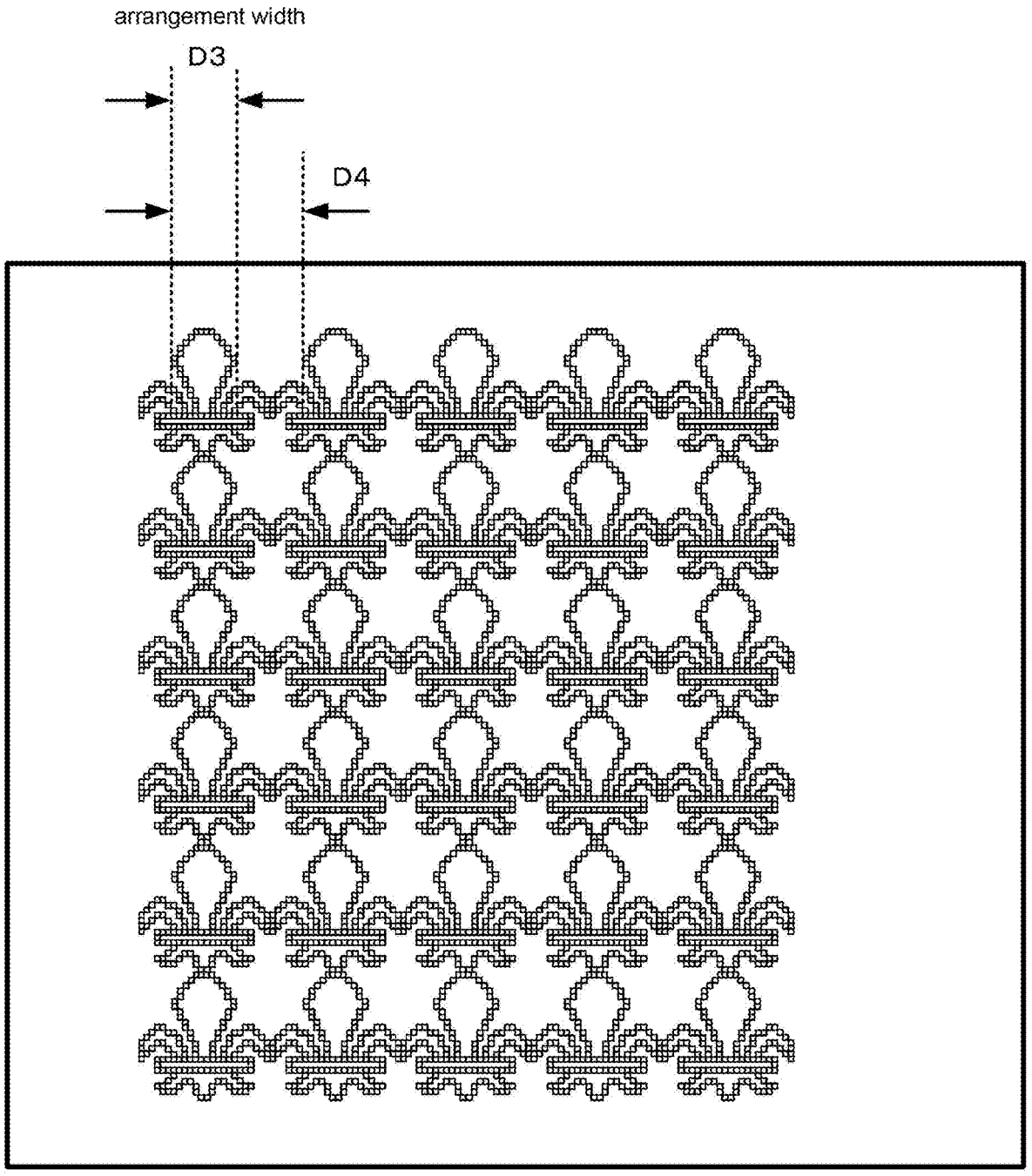
FIG. 15 is a drawing showing an example of a pattern sewn by the sewing machine of the third embodiment.

FIG. 15 is a drawing showing an example of the pattern sewn by the sewing machine of the present embodiment. In the pattern shown in FIG. 15, ten pattern lines are sewn with an arrangement width D3. Each of the pattern lines is formed by six object patterns. The width of the object pattern is the distance D3, and the arrangement width between the pattern lines is the distance D3. Namely, the object patterns of the neighboring pattern lines are in contact with each other. In the present embodiment, the maximum amplitude Amax of the needle 3 is specified to be twice or more of the distance D3. In other words, the arrangement width of the two pattern lines is a distance D4, which is twice of the distance D3, and the distance D4 is equal to or less than the maximum amplitude Amax of the needle 3. In this case, the first and second lines are sewn without moving the carriage, and then the carriage is slid by the distance D4.

[3-1. Configuration]

Figure 16:
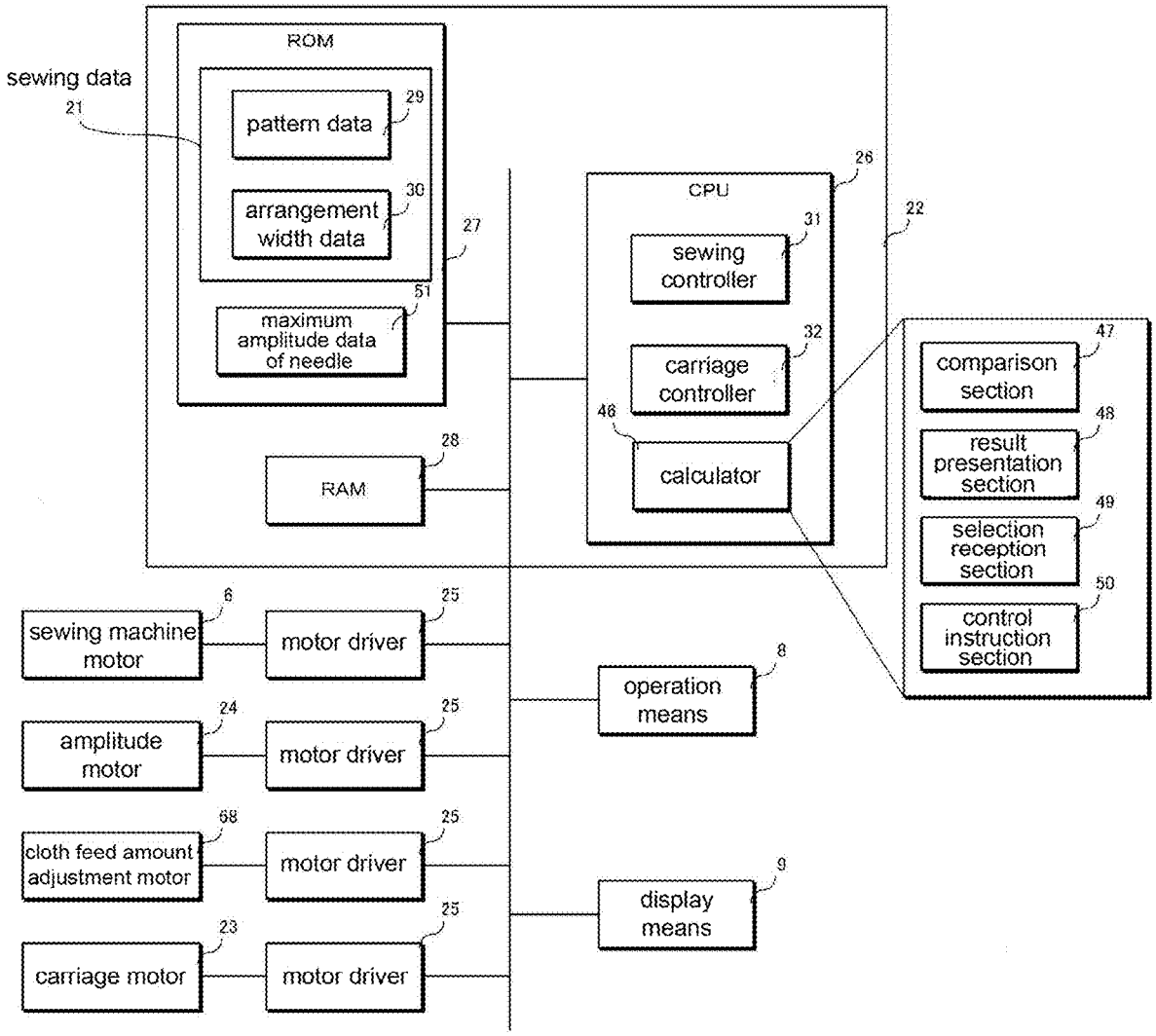
FIG. 16 is a block diagram showing a functional configuration of the sewing machine of the third embodiment.

FIG. 16 is a block diagram showing a configuration of the sewing machine 1 of the present embodiment. As shown in FIG. 16, in the sewing machine 1 of the present embodiment, a calculator 46 is newly provided on the CPU 26 in addition to the configuration of the sewing machine 1 of the first embodiment. In addition, a data 51 of the maximum amplitude Amax of the needle is stored in the ROM 27. Note that the same reference numerals are added to the same configuration common with the first embodiment to avoid duplicate explanation.

The calculator 46 calculates how much pattern lines can be sewn only by the amplitude of the needle 3 without moving the carriage 10. When two or more pattern lines can be sewn only by the amplitude of the needle 3, the calculator 46 receives selection from the user about a timing when the carriage 10 is moved. The calculator 46 has a comparison section 47, a result presentation section 48, a selection reception section 49, and a control instruction section 50.

The comparison section 47 compares the maximum amplitude Amax of the needle 3 with the distance D3 of the width of the object pattern. The comparison section 47 compares the values by dividing the maximum amplitude Amax of the needle 3 by the distance D3 of the width of the object pattern. For example, when the maximum amplitude Amax of the needle 3 is 10 mm and the distance D3 of the width of the object pattern is 4 mm, a calculation result shows that two pattern lines can be sewn only by the amplitude of the needle 3 without moving the carriage 10.

The result presentation section 48 controls the display means 9 to provide the calculation result calculated by the comparison section 47 to the user, and simultaneously provide options of the number of lines to be sewn only by the amplitude of the needle 3 without moving the carriage 10. The number of lines provided here is equal to or less than the maximum number of pattern lines calculated by the comparison section 47 to be sewn only by the amplitude of the needle 3 without moving the carriage 10. When the maximum number of pattern lines to be sewn is calculated as three in the comparison section 47, the number of lines provided is one to three.

The selection reception section 49 receives selection from the user about the number of lines to be sewn only by the amplitude of the needle 3 without moving the carriage 10. The user operates the operation means 8 to input the desired number of lines to be sewn only by the amplitude of the needle 3 without moving the carriage 10 from the number of lines displayed on the display means 9.

The control instruction section 50 transfers the desired number of lines received from the user to the carriage controller. Because of this, the carriage controller outputs to the motor drivers 25 the control command including the control amount of the carriage motor 23 calculated from the number of pattern lines read from the pattern data, the arrangement width between the pattern lines read from the arrangement width data 30, and the number of pattern lines selected by the user to be sewn only by the amplitude of the needle 3 without moving the carriage 10. The motor drivers 25 drives the carriage motor 23 based on the control command.

(Control Example of Carriage)

Figure 17:
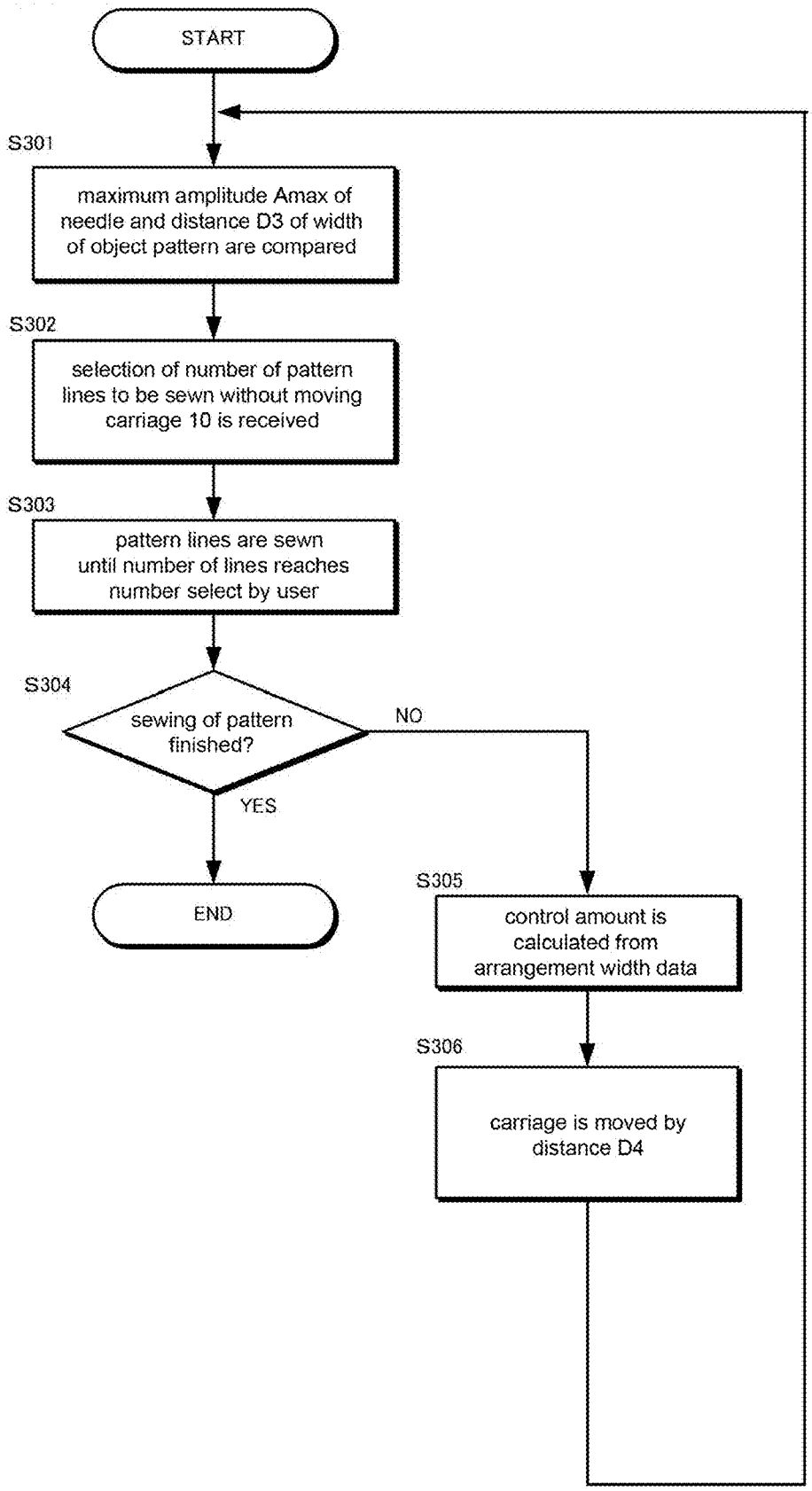
FIG. 17 is a flowchart showing a control operation of the carriage in the sewing machine of the third embodiment.

Hereafter, the control operation of moving the carriage 10 according to the arrangement width D4 of two pattern lines when sewing the pattern will be explained. FIG. 17 is a flowchart showing a control operation of the carriage 10.

The maximum amplitude Amax of the needle and the distance D3 of the width of the object pattern are compared (S301). The comparison result is provided to the user and the selection of the number of pattern lines to be sewn only by the amplitude of the needle 3 without moving the carriage 10 is received (S302). Here, suppose that the user selects to sew two pattern lines only by the amplitude of the needle 3 without moving the carriage 10.

Without changing the position of the carriage 10, the pattern lines are sewn until the number of lines reaches the number select by the user (S303). When the user selects two pattern lines to be sewn in S302, the carriage is not extended and contracted until two pattern lines are sewn. Namely, the user sews the first line and then the user moves the fabric to the start position of the second pattern line in the feeding direction. Accordingly, the fabric 100 is moved only in the sewing direction without being moved in the amplitude direction of the needle. Then, sewing of the second pattern line is performed. When the pattern is not completed (NO in S304), the carriage controller 32 reads the arrangement width D4 of the first and the third pattern lines and calculates the control amount of the carriage motor 23 (S305). The calculated control amount is stored. Then, the carriage controller 32 controls the carriage motor 23 based on the calculated control amount to extend or contract the carriage 10 in the amplitude direction of the needle by the distance D4 (S306). The carriage 10 is moved after receiving the signal of the end of sewing from the sewing controller 31.

Then, sewing of the third and the following pattern lines is performed in the same manner as the sewing of the first and the second pattern lines. Namely, the procedures of the comparison between the maximum amplitude Amax of the needle and the distance D3 of the width of the object pattern, the provision of the comparison result to the user, the reception of the selection from the user, and the sewing of the selected number of pattern lines without changing the position of the carriage are repeated. In the pattern formed by arranging the object patterns at equal intervals of the distance D3 as shown in the present embodiment, although the arrangement width D4 of the third and fifth pattern lines can be read to calculate the control amount of the carriage motor 23 same as the sewing of the first and the second pattern lines, the carriage controller 32 controls the carriage motor 23 based on the preliminarily recorded control amount to extend or contract the carriage 10 in the amplitude direction of the needle by the distance D4. These processes are repeated until the pattern is completed.

[3-2. Operations]

Hereafter, procedures of sewing an embroidery of the pattern using the sewing machine of the present embodiment will be explained. For the purpose of explanation, the pattern shown in FIG. 15 is used as the completed pattern. The pattern shown in FIG. 15 can be sewn based on the sewing data made by using the method described in the second embodiment or can be sewn based on the preliminarily stored sewing data.

The sewing machine 1 saws the pattern on the left end side of the fabric 100. The sewing is performed sequentially from the pattern line of the left side to the pattern line of the right side. In the pattern shown in FIG. 15, ten pattern lines are sewn at the equal arrangement width D3. The sewing machine 1 performs sewing of each of the pattern lines by sliding the fabric guide 14 by the distance D4, which is twice of the distance D3, each. FIG. 18A to 18F are drawings showing a procedure of sewing the pattern of FIG. 15.

Figure 18A:
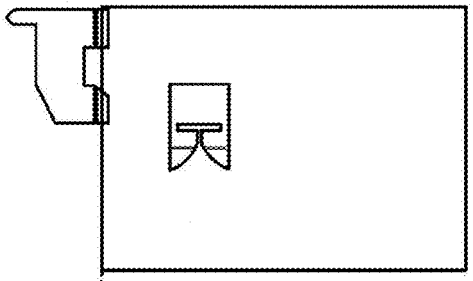
FIG. 18A to 18F are schematic views showing a procedure of sewing the pattern in the third embodiment.
Figure 18B:
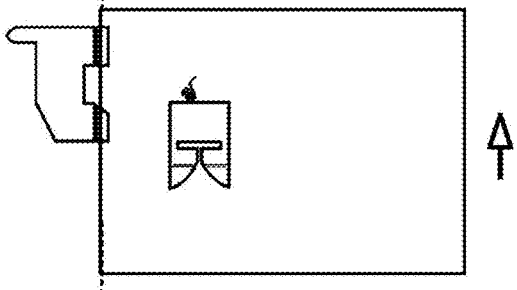
Figure 18C:
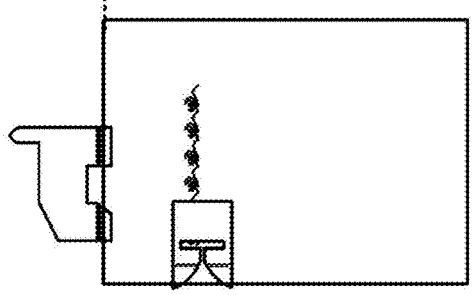
Figure 18D:
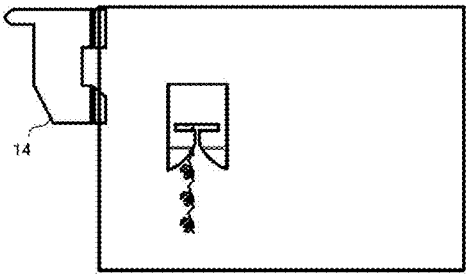
Figure 18E:
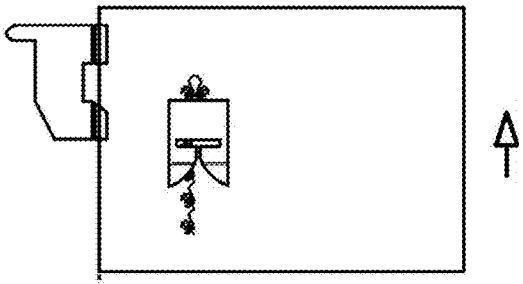
Figure 18F:
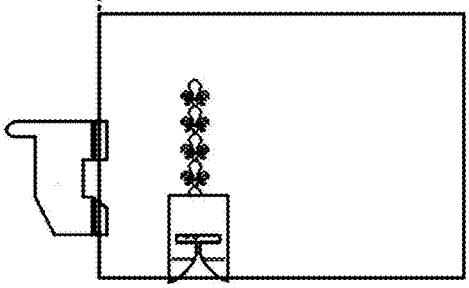

First, as a preparatory stage of sewing the pattern, the fabric guide 14 is fixed to the carriage 10. The user arranges the fabric 100 on the fabric guide 14 so that the left end portion of the fabric 100 extends along the guide portion 16. Then, sewing of the first pattern line is performed (FIGS. 18A to 18C). When the sewing of the first pattern line is finished, the sewing controller 31 raises the presser foot 62. Then, a sewing position of the second pattern line is adjusted and the second pattern line is sewn (FIGS. 18D to 18F). The pattern of the second line is the laterally inverted pattern of the first line. When the sewing data 21 is the sewing data including the data of the number of pattern lines forming whole the pattern and the width between the pattern lines, sewing is performed according to the sewing data 21. On the other hand, when the sewing data 21 is the data including the data of the needle location coordinate and the number of needles of one pattern line as the basic pattern line, the number of pattern lines forming whole the pattern, the data of the widths between each of the pattern lines, and the line number of the pattern lines for inversing shifting the pattern, the pattern data of the first pattern line (basic pattern line) is read. Then, based on the data which shows that the second line is the line to be inverted, the data of the pattern of the first pattern line is copied and used as the pattern data of the second line while being inverted laterally.

Then, when the sewing of the second line is finished, the carriage controller 32 calls the arrangement width D4 between the first and third lines from the arrangement width data 30. Then, the control amount of the carriage motor 23 is calculated based on the arrangement width. The calculated control amount is a value for moving the carriage 10 to the left direction by the distance D4. By the driving force of the carriage motor 23, the carriage 10 is precisely slid to the left direction by a predetermined distance D4. In accordance with the movement of the fabric guide 14, the guide portion 16 is also moved to the left side by the predetermined distance D4. The fabric 100 is moved together with the guide portion 16 to the left side by the predetermined distance D4. Because of this, the needle location point to the fabric 100 is displaced in the amplitude direction of the needle by the predetermined distance D4. By repeating the above descried processes, the pattern is sewn.

[3-3. Effects]

In the above described embodiment, when an assembly of the object patterns having a width of equal to or less than the maximum amplitude Amax of the needle 3 is used for the pattern, the distance of moving the carriage 10 can be selected by the user from positive integral multiples of the width of the object pattern. Because of this, until the distance reaches the integral multiple selected by the user, the position of the sewing direction can be adjusted each time when finishing sewing the object pattern of each line and the sewing can be performed while the needle is displaced from the center of the amplitude without moving the carriage. Consequently, frequency of the cloth feed in the amplitude direction of the needle is reduced as compared with the case where the cloth is fed each time when one pattern line is sewn. Accordingly, high-quality pattern can be sewn more precisely.

In the present embodiment, the user sews two pattern lines without moving the carriage. However, the distance of moving the carriage 10 can be specified to be the maximum value in the positive integral multiples of the width of the object pattern within the range of equal to or less than the maximum amplitude of the needle 3. For example, when the width of the object pattern is 3 mm and the maximum amplitude of the needle 3 is 10 mm, the positive integral multiples of 3 mm are 3 mm, 6 mm, 9 mm, 12 mm and so on. The maximum value within the range of equal to or less than the maximum amplitude of the needle 3 is 9 mm. Thus, the distance of moving the carriage 10 is specified to 9 mm. Because of this, frequency of the cloth feed in the amplitude direction of the needle can be minimized. On the other hand, when the width of the object pattern is extremely shorter than the amplitude of the needle, if the distance of moving the carriage 10 is specified to the maximum value in the positive integral multiples of the width of the object pattern, sewing of the pattern lines is performed in a state that the needle is stroked largely. In the sewing machine where the quality of the sewn pattern is influenced by the amount of the amplitude of the needle 3, the maximum value in the positive integral multiples is not necessarily selected. By arbitrarily selecting the distance of moving the carriage 10 from the positive integral multiples of the width of the object pattern according to the performance of the sewing machine for sewing the pattern, although the positive integral multiple is two or more, high-quality pattern can be sewn while frequency of the cloth feed in the amplitude direction of the needle is reduced.

4. Fourth Embodiment

In the sewing machine of the previous embodiment, the fabric 100 is fed in one direction when sewing each of the pattern lines. The present embodiment relates to the sewing machine 1 for feeding the fabric 100 in one direction when sewing the patterns of odd number lines and feeding the fabric 100 in the other direction when sewing the pattern of the even number lines. Note that the same reference numerals are added to the same configuration common with the first embodiment to avoid duplicate explanation.

[4-1. Configuration]

(Control Example of Carriage)

Figure 19:
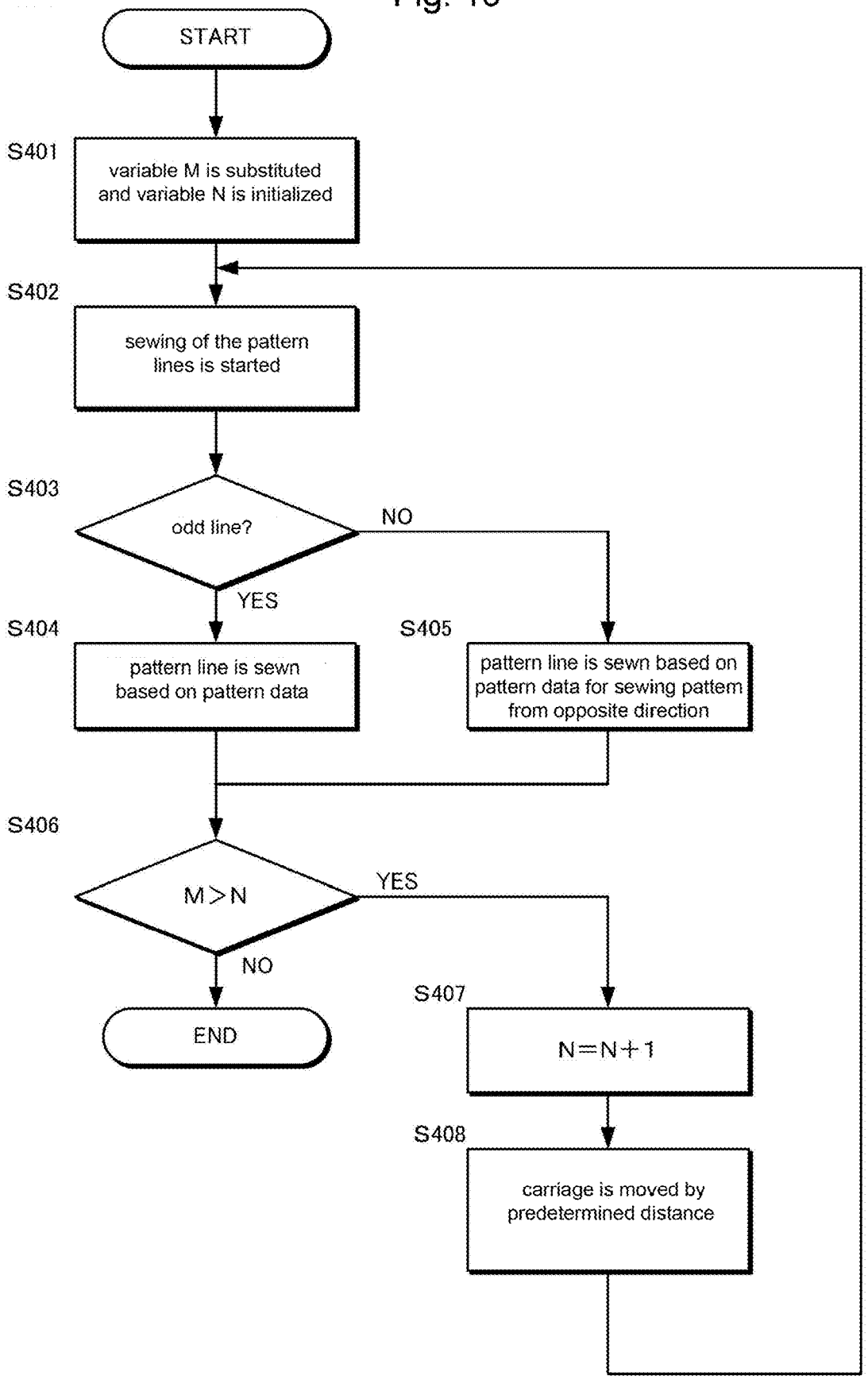
FIG. 19 is a flowchart showing a control operation of the carriage in the sewing machine of the fourth embodiment.

Hereafter, the control operation of the carriage 10 when the cloth feed direction is different between the odd number lines and the even number lines will be explained. FIG. 19 is a flowchart showing the control operation of the carriage 10.

When sewing of the pattern lines is started, the sewing controller 31 calls the sewing data 21. Then, the sewing controller 31 refers to the number of pattern lines required for completion included in the sewing data 21 and substitutes the number of pattern lines in a variable M. The variable M is a variable number changed depending on the pattern to be sewn. For example, when whole the pattern is formed by five pattern lines, the variable M is 5. Alternatively, when whole the pattern is formed by six pattern lines, the variable M is 6. In addition, the sewing controller 31 initialize a variable N which shows the number of sewn pattern lines to N=1 (S401).

Then, sewing of the pattern lines is started (S402). When the sewing is started, it is judged whether the pattern line to be sewn is the odd line or the even line. The judgment of the odd line or the even line is made by dividing the variable N by 2 to judge whether or not a remainder is generated (S403). When the remainder is 1 and the pattern line is judged as the odd line (YES in S403), the sewing controller 31 reads the pattern data of the pattern line to be sewn. The pattern data includes the needle location coordinate for the case when sewing is performed while the feed dog 2*a* is fed in a forward direction. The sewing controller 31 feeds the feed dog 2*a* in the forward direction based on the pattern data to sew the pattern lines (S404). On the other hand, when the remainder is 0 and the pattern line is judged as the even line (NO in S403), the sewing controller 31 reads the pattern data of the pattern line to be sewn. Then, based on the read pattern data, the pattern data for sewing the pattern from an opposite direction is made. In the pattern data for sewing the pattern from an opposite direction, the needle location coordinate is replaced to start the sewing from the seam finally formed. Accordingly, when the sewing controller 31 drives the feed dog based on the pattern data for sewing the pattern from an opposite direction to sew the pattern lines, the feed dog is operated in the other direction as compared with the case of the pattern data (S405).

When the sewing of the pattern line is finished, the sewing controller 31 judges whether or not sewing of all pattern lines is finished (S406). The judgment is made by comparing the variable N with the variable M. When the variable N is less than the variable M (YES in S406), sewing of the next pattern line is prepared. Namely, the sewing controller 31 increments the variable N (S407). Then, the carriage controller 32 extends or contracts the carriage 10 in the amplitude direction of the needle by the predetermined distance to move the fabric 100 to the sewing position of the next pattern line (S408). The above described procedures are repeated until sewing of all pattern lines is completed. When the variable N is equal to the variable M (NO in S406), it is judged that sewing of all pattern lines is finished. Thus, sewing of the pattern is finished.

[4-2. Operations]

Hereafter, procedures of sewing an embroidery of the pattern using the sewing machine of the present embodiment will be explained. For the purpose of explanation, the pattern shown in FIG. 8 is used as the completed pattern. The pattern is sewn on the left end side of the fabric 100. The sewing is performed sequentially from the pattern line of the left side to the pattern line of the right side. The sewing machine 1 performs sewing of each of the pattern lines by sliding the fabric guide 14 by the distance D2 each. FIGS. 20A to 20H are drawings showing the procedure of sewing the pattern of FIG. 8.

First, as a preparatory stage of sewing the pattern, the fabric guide 14 is fixed to the carriage 10. The user arranges the fabric 100 on the fabric guide 14 so that the left end portion of the fabric 100 extends along the guide portion 16. Then, sewing is started when the tact switch 81 is operated. The first line is sewn while the fabric 100 is fed in the forward direction. When the seams are formed until the number of needles stored in the pattern data 29, the sewing of the first pattern line is finished (FIGS. 20A to 20C).

When the sewing of the first pattern line is finished, the carriage controller 32 calls the arrangement width D2 between the first and second pattern lines from the arrangement width data 30. Then, the control amount of the carriage motor 23 is calculated from the arrangement width D2. The carriage motor 23 extends the carriage 10 by the predetermined distance D2 to precisely slide the fabric guide 14 to the left direction by the predetermined distance D2. The fabric 100 is moved together with the movement of the guide portion 16 of the fabric guide 14 to the left side by the predetermined distance D2. Because of this, the needle location point to the fabric 100 is also displaced in the amplitude direction of the needle by the predetermined distance D2 (FIG. 20D).

Figures 20A, 20B, 20C, 20D, 20E, 20F, 20G, 20H:
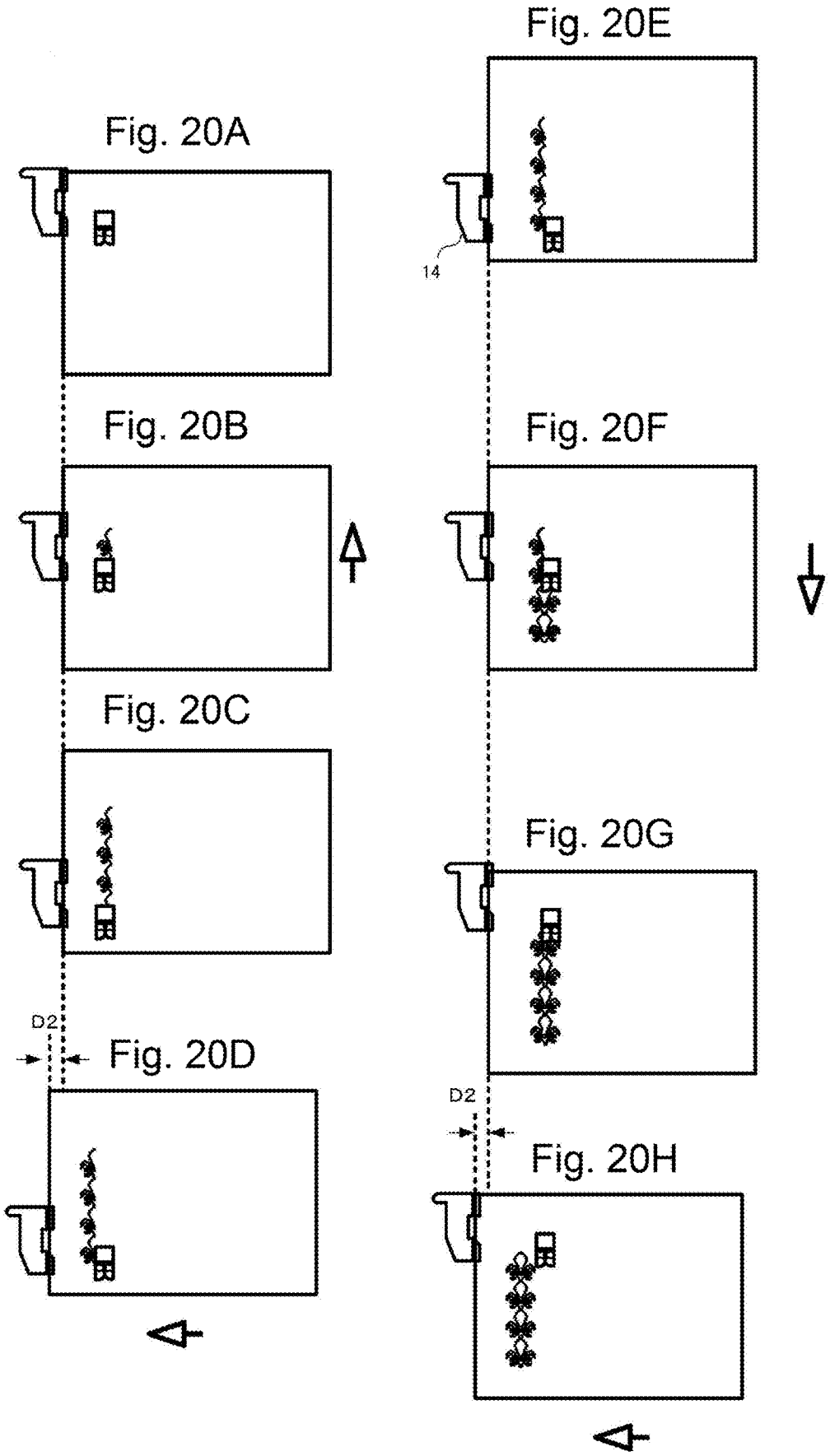
FIGS. 20A to 20H are schematic views showing a procedure of sewing the pattern in the fourth embodiment.

Then, sewing of the second pattern line is performed (FIGS. 20E to 20G). The second pattern line is sewn while the fabric 100 is fed in the opposite direction. When the sewing of the second pattern line is finished, the carriage controller 32 controls the carriage motor 23 based on the calculated control amount. Because of this, the fabric guide 14 is slid precisely by the predetermined distance and the fabric 100 is moved by the predetermined distance D2 (FIG. 20H). By repeating the above descried processes, the pattern is sewn.

[4-3. Effects]

In the sewing machine of the above described embodiment, the fabric is fed in one direction by the feed dog 2*a* when sewing the odd lines of the object pattern. On the other hand, the fabric is fed in the other direction when sewing the even lines of the object pattern. Because of this, hand working of the user to move the fabric to the start position of the next pattern line is eliminated. Accordingly, the position can be more precisely located and high-quality pattern can be sewn.

5. Other Embodiments

Although the embodiments of the present invention are explained above, various omissions, replacements and changes are possible within a range being not deviated from the subject-matter of an invention. The embodiments and variation examples are included in the scope and the subject-matter of the present invention, and included in the invention described in the claims and equivalents.

Note that, this invention is not limited to the above-mentioned embodiments. Although it is to those skilled in the art, the following are disclosed as the one embodiment of this invention.

- Mutually substitutable members, configurations, etc. disclosed in the embodiment can be used with their combination altered appropriately.
- Although not disclosed in the embodiment, members, configurations, etc. that belong to the known technology and can be substituted with the members, the configurations, etc. disclosed in the embodiment can be appropriately substituted or are used by altering their combination.
- Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A sewing machine, comprising:

a fabric guide having a guide portion and a holding portion, the guide portion extending in a sewing direction, the holding portion having a pressing roller which is rotated with respect to the sewing direction for pressing a fabric abutted on the guide portion;

a carriage having a fixing portion which fixes the fabric guide, the carriage being slidable in an amplitude direction of a needle by a predetermined distance;

a controller for sliding the carriage in the amplitude direction of the needle by the predetermined distance; and a cloth presser foot which is raised from the fabric when the carriage is slid in the amplitude direction of the needle.

2. The sewing machine according to claim 1, wherein the sewing machine sews a pattern by combining in the amplitude direction a plurality of object patterns having a width equal to or narrower than a maximum amplitude of the needle attached to the sewing machine, and the controller makes the carriage slide by a distance equal to or less than the maximum amplitude of the needle attached to the sewing machine, the distance being a positive integral multiple of the width of each of the object patterns.

3. The sewing machine according to claim 2, wherein the controller has:

a calculator for comparing the maximum amplitude of the needle with the width of each of the object patterns; and a sewing controller for making the needle saw the plurality of object patterns arranged in the amplitude direction within a range of the maximum amplitude of the needle without moving the carriage when the maximum amplitude of the needle compared by the calculator is equal to or more than twice the width of each of the object patterns.

4. The sewing machine according to claim 3, wherein the controller has a carriage controller for making the carriage slide by the width of the plurality of the object patterns after the plurality of object patterns are sewn.

5. The sewing machine according to claim 2, wherein the controller has a sewing function for inversing the object patterns neighboring in the amplitude direction of the needle with each other with respect to the amplitude direction of the needle.

6. The sewing machine according to claim 2, wherein the controller has a sewing function for reversing the sewing direction of the neighboring object patterns with each other.

* * * * *